US009285765B2

(12) United States Patent
Anan et al.

(10) Patent No.: US 9,285,765 B2
(45) Date of Patent: Mar. 15, 2016

(54) DEVELOPER SUPPLY CARTRIDGE WITH SHUTTER PORTION FOR OPENING AND CLOSING A SUPPLY OPENING

(71) Applicant: CANON KABUSHIKI KAISHA, Tokyo (JP)

(72) Inventors: Osamu Anan, Susono (JP); Teruhiko Sasaki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/225,884

(22) Filed: Mar. 26, 2014

(65) Prior Publication Data

US 2014/0294448 A1 Oct. 2, 2014

(30) Foreign Application Priority Data

Mar. 28, 2013 (JP) ..... 2013-069426

(51) Int. Cl.
*G03G 15/08* (2006.01)
*G03G 21/18* (2006.01)

(52) U.S. Cl.
CPC ..... *G03G 21/18* (2013.01); *G03G 15/0886* (2013.01); *G03G 21/1821* (2013.01); *G03G 2215/0132* (2013.01)

(58) Field of Classification Search
CPC ..... G03G 21/18; G03G 15/0886
USPC ..... 399/258, 262
See application file for complete search history.

(56) References Cited

U.S. PATENT DOCUMENTS 5,920,753 A 7/1999 Sasaki et al.
6,137,971 A 10/2000 Sasaki et al.
6,137,973 A 10/2000 Nishiuwataoko et al.
6,141,508 A 10/2000 Sasaki et al.
6,178,302 B1 1/2001 Nagashima et al.
6,183,075 B1 2/2001 Sasaki
6,327,448 B1 12/2001 Sasaki
6,714,749 B2 3/2004 Sato et al.
6,901,229 B2 5/2005 Nishiuwatoko et al.
7,062,195 B2 6/2006 Kurihara et al.
7,099,607 B2 8/2006 Suzuki et al.
7,194,220 B2 3/2007 Sasaki et al.
7,366,439 B2 4/2008 Anan et al.
7,457,569 B2 * 11/2008 Kawai ..... 399/258
7,720,412 B2 5/2010 Anan et al.
8,095,036 B2 1/2012 Ysohino et al.
8,121,517 B2 2/2012 Asanuma et al.
8,160,477 B2 4/2012 Anan et al.

(Continued)

FOREIGN PATENT DOCUMENTS

JP 4-696168 B2 6/2011

*Primary Examiner* — Quana M Grainger

(74) *Attorney, Agent, or Firm* — Fitzpatrick, Cella, Harper & Scinto

(57) ABSTRACT

A developer supply cartridge detachably mountable to a main assembly of an image forming apparatus includes: a developer accommodating portion; a shutter portion movable between a closed position and an open position; and a movable portion for moving the shutter portion. The movable portion is movable between a first position where the shutter portion is positioned in the closed position. The movable portion performs a preventing operation for preventing movement thereof to the first position by engagement thereof with an engaging portion, provided in the main assembly side, when the movable portion is positioned in the second position during movement of the developer supply cartridge to the main assembly.

24 Claims, 23 Drawing Sheets

(56) References Cited

U.S. PATENT DOCUMENTS

| | | | | |
|---|---|---|---|---|
| 8,180,262 | B2 * | 5/2012 | Kawai | 399/258 |
| 8,270,876 | B2 | 9/2012 | Morioka et al. | |
| 8,369,744 | B2 | 2/2013 | Asanuma et al. | |
| 8,380,111 | B2 * | 2/2013 | Murakami et al. | 399/258 |
| 8,494,409 | B2 | 7/2013 | Kawai et al. | |
| 8,577,252 | B2 | 11/2013 | Anan et al. | |
| 8,688,004 | B2 | 4/2014 | Asanuma et al. | |
| 2005/0169672 | A1 * | 8/2005 | Ban et al. | 399/258 |
| 2013/0058675 | A1 | 3/2013 | Anan et al. | |
| 2014/0003838 | A1 | 1/2014 | Kawai et al. | |
| 2014/0112686 | A1 | 4/2014 | Asanuma et al. | |

* cited by examiner (a)

(b)

(a)

(b)

(a)

(R-R SECTION)

(b)

(a)

(R-R SECTION)

(b)

(a)

(R-R SECTION)

(b)

(a)

(R-R SECTION)

(b)

(a)

(R-R SECTION)

(b)

(a)

(R-R SECTION)

(b)

DEVELOPER SUPPLY CARTRIDGE WITH SHUTTER PORTION FOR OPENING AND CLOSING A SUPPLY OPENING

FIELD OF THE INVENTION AND RELATED ART

The present invention relates to a developer supply cartridge, a process cartridge and an image forming apparatus.

As a conventional image forming apparatus for forming an image on a recording material (medium) by using an electrophotographic process, an image forming apparatus employing a so-called process cartridge type has been known. The process cartridge type refers to a type in which an image bearing member as an electrophotographic photosensitive member and a process means actable on the image bearing member are integrally assembled into a unit, and the unit is made detachably mountable to an image forming apparatus main assembly. According to this type, maintenance of the image forming apparatus can be performed by a user himself (herself), so that operativity can be improved.

Further, the image bearing member and the process means actable thereon are different in service (useful) life, and therefore there is a constitution in which the process cartridge in which the image bearing member and a developing device are integrally assembled and a developer supply cartridge for supplying a developer to the process cartridge are provided as separate members. In such a constitution, in a state in which both of the developer supply cartridge and the process cartridge are mounted in the image forming apparatus, the developer is supplied from the developer supply cartridge to the process cartridge. Further, a type in which the developer is supplied little by little through a developer supply opening provided to the developer supply cartridge is employed.

Further, when the user exchanges the process cartridge and the developer supply cartridge, there is a need to take countermeasure to prevent hands and clothes of the user from being contaminated with the developer. For that reason, with respect to the developer supply opening and a developer receiving opening, in order to prevent leaking-out of the developer to the periphery, it would be considered that openable shutter mechanisms having various constitutions are used. As an example thereof, a rotary valve type has been known (Japanese Patent No. 4696168).

The shutter mechanism using the rotary valve type opens and closes the developer supply opening of the developer supply cartridge and has a constitution in which a rotatable member having a cylindrical shape is rotatably supported by a frame provided in a position of the developer supply opening. The rotatable member is provided with a through hole which opens at an outer peripheral surface thereof, and is constituted so as to create, by rotation thereof, a communication state between the developer supply opening and the through hole and a non-communication state between the developer supply opening and the through hole. The communication state between the developer supply opening and the through hole is a state in which the developer supply opening is open, and the non-communication state between the developer supply opening and the through hole is a state in which the developer supply opening is closed.

Opening and closing of the developer supply opening are performed by rotating the rotatable member by engagement between a supply-side movable portion provided to the developer supply cartridge and a receiving-side movable portion provided to the process cartridge. The supply-side movable portion is provided coaxially with a rotation shaft of the rotatable member, and the rotatable member and the supply-side movable portion are integrally rotated with each other. When the developer supply cartridge is moved to a predetermined mounting position in an apparatus main assembly in a state in which the process cartridge is mounted in the image forming apparatus, the receiving-side movable portion provided to the process cartridge and the supply-side movable portion are engaged with each other, so that the supply-side movable portion is rotated and thus the rotatable member is rotated. As a result, when the developer supply cartridge is mounted in the image forming apparatus in a state in which the developer supply opening is closed, the state of the developer supply opening is switched from the closed state to the open state. That is, in a period until the developer supply cartridge is mounted in the predetermined mounting position, the developer supply opening can be placed in the closed state, so that leaking-out of the developer during the mounting can be prevented.

However, the supply-side movable portion is disposed in a position where the user can touch the supply-side movable portion, and by the touch of the supply-side movable portion by the user, the supply-side movable portion is positioned in an erroneous phase in some cases. That is, in a state in which the developer supply cartridge is not mounted in the image forming apparatus, the developer supply opening should be placed in the closed state but there is a possibility that the developer supply opening is placed in the open state. In this state, when the developer supply cartridge is mounted in the image forming apparatus, the developer supply opening is placed in the closed state during completion of the mounting. When the image forming apparatus is operated as it is, the developer is not supplied from the developer supply cartridge to the process cartridge, and therefore image defect occurs. Further, the developer clogs the developer supply opening to increase a driving torque of the developer supply cartridge, and therefore an improper operation of the image forming apparatus is generated.

SUMMARY OF THE INVENTION

A principal object of the present invention is to provide a developer supply cartridge, a process cartridge and an image forming apparatus which are capable of placing a developer supply opening in an open state even in any opening and closing state of the developer supply opening when the developer supply cartridge is mounted to an image forming apparatus main assembly or the process cartridge.

According to an aspect of the present invention, there is provided a developer supply cartridge detachably mountable to a main assembly of an image forming apparatus for forming an image on a recording material by a developer, the developer supply cartridge comprising: an accommodating portion, provided with a supply opening for permitting discharge of a developer, for accommodating the developer; a shutter portion movable between a closed position where the supply opening of the accommodating portion is blocked from an outside of the accommodating portion and an open position where the supply opening is open to the outside; and a movable portion for moving the shutter portion, wherein the movable portion is movable between a first position where the shutter portion is positioned in the closed position and a second position where the shutter portion is positioned in the open position, and wherein during movement of the developer supply cartridge to a mounting position when the developer supply cartridge is mounted to the main assembly, the movable portion is moved with the movement of the developer supply cartridge by engagement thereof with an engaging portion provided in a main assembly side so that the movable portion is engaged with the engaging portion in the first position to start movement thereof and is positioned in the second position when the developer supply cartridge reaches the mounting position, wherein the movable portion performs a preventing operation for preventing movement thereof to the first position by engagement thereof with the engaging portion when the movable portion is positioned in the second position during mounting of the developer supply cartridge to the main assembly.

These and other objects, features and advantages of the present invention will become more apparent upon a consideration of the following description of the preferred embodiments of the present invention taken in conjunction with the accompanying drawings.

Figure 15:
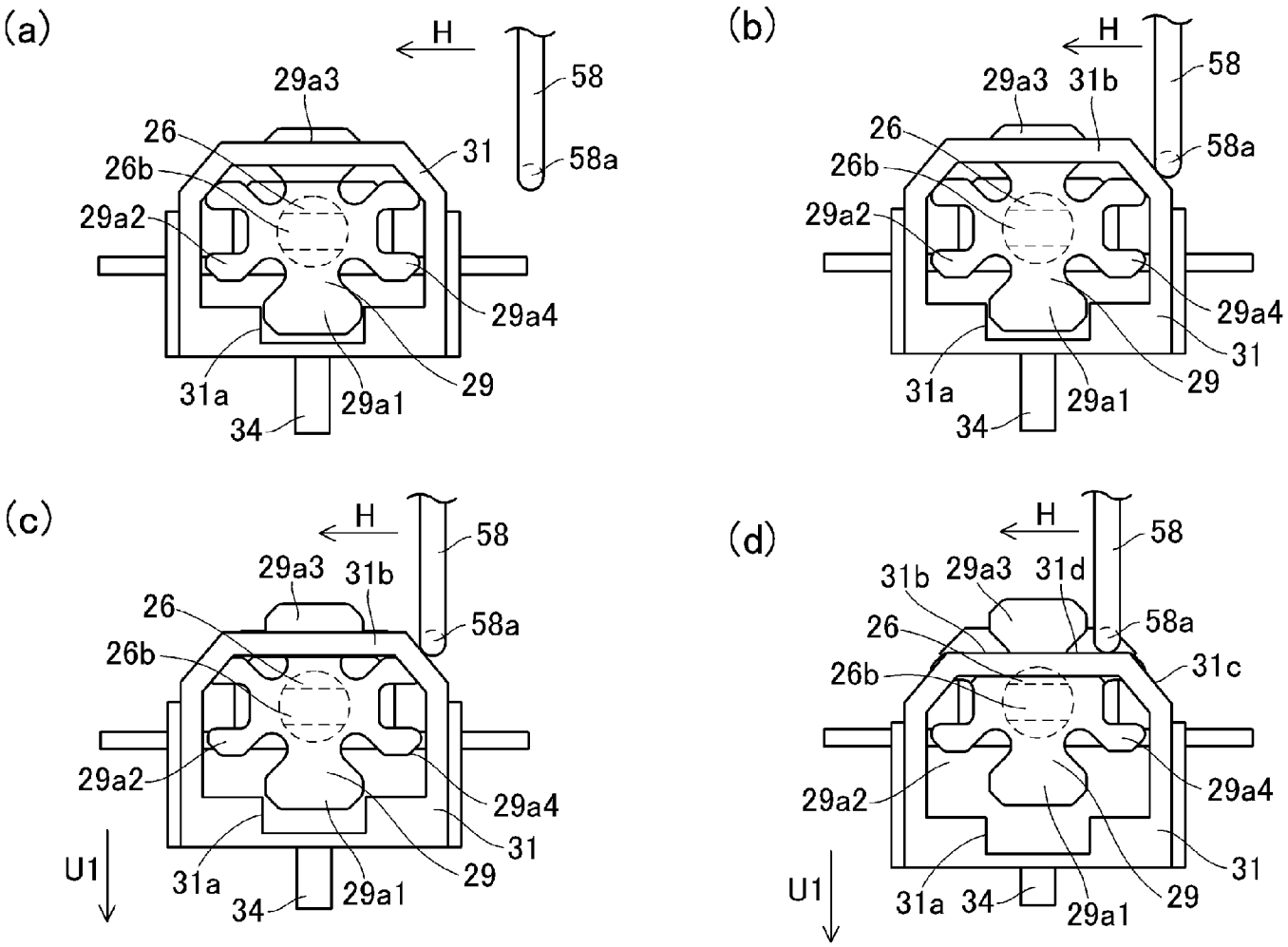
Figure 16:
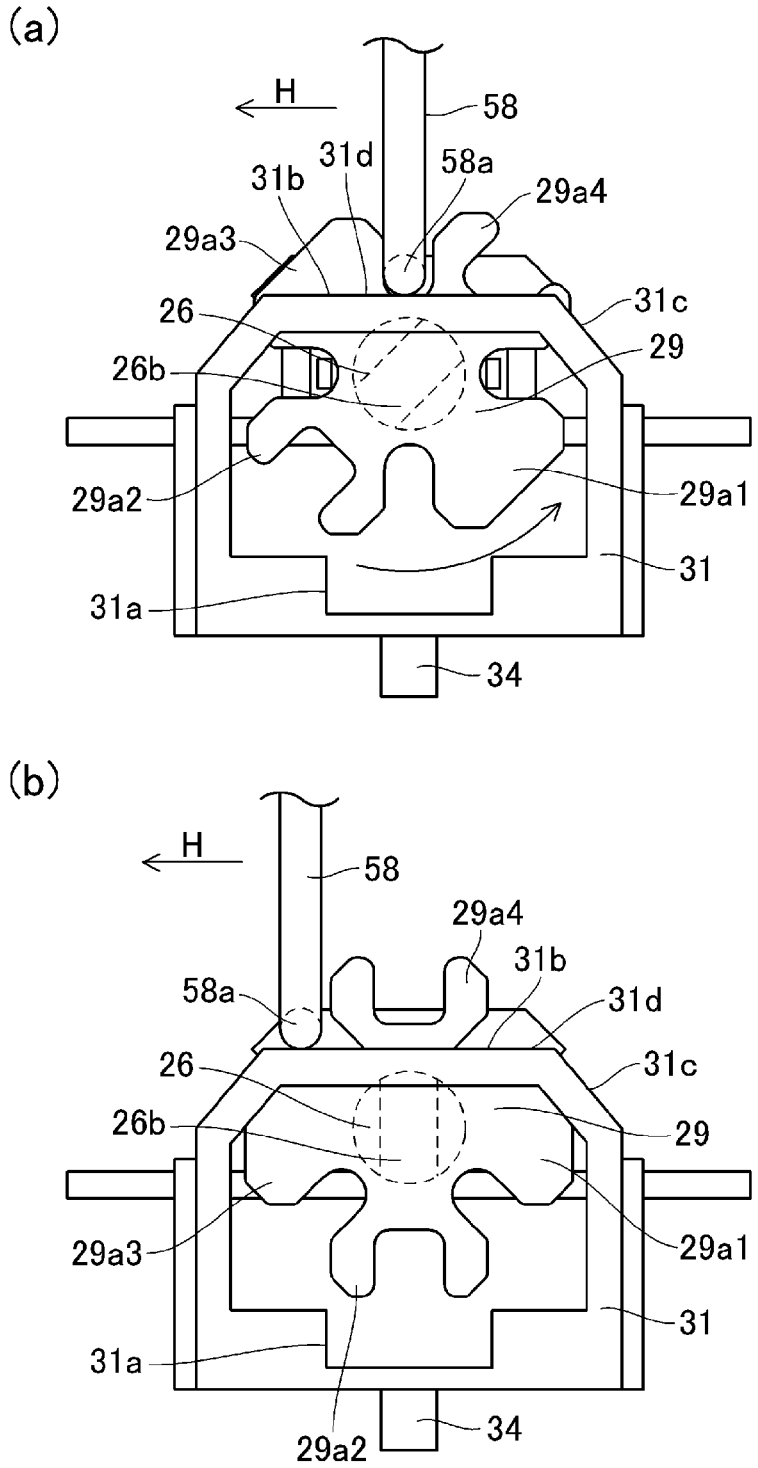
Figure 17:
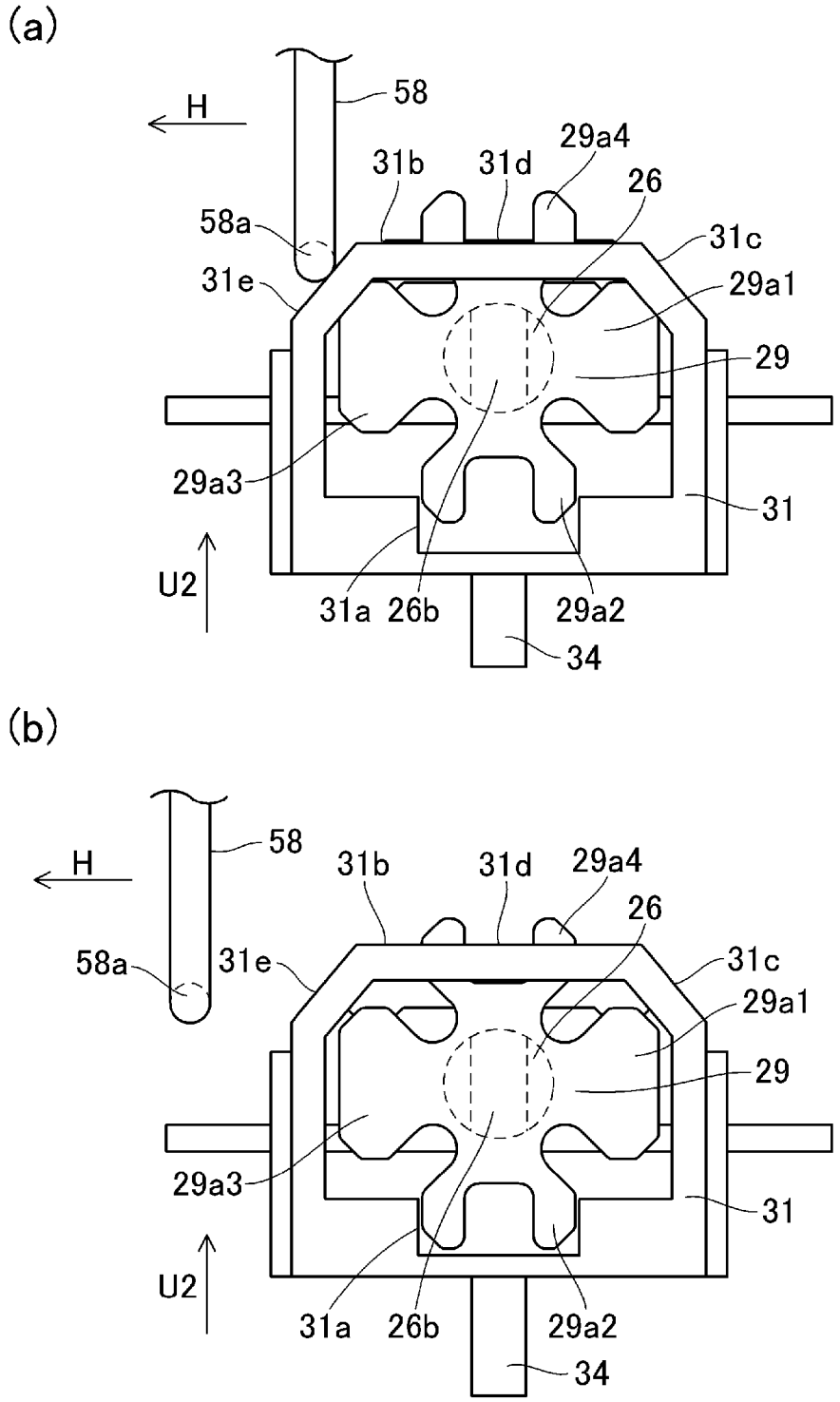

Parts (*a*) to (*d*) of FIG. 15, (*a*) and (*b*) of FIG. 16 and (*a*) and (*b*) of FIG. 17 are illustrations showing first to third operations, respectively.

Figure 18:
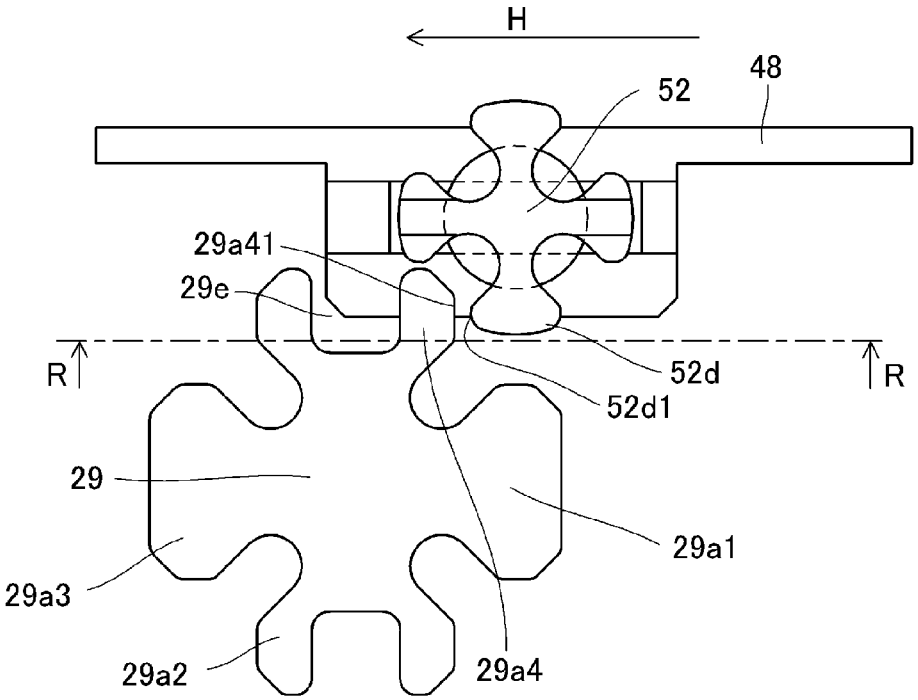
Figure 18:
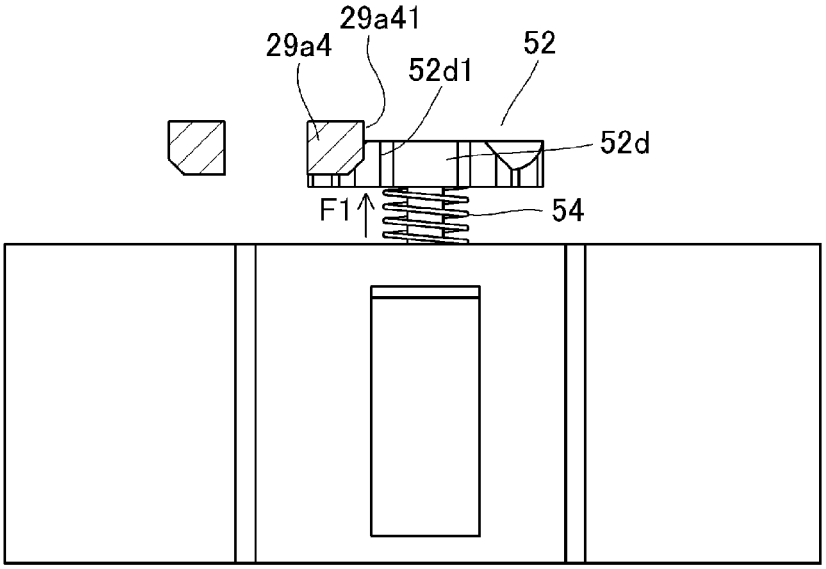
Figure 19:
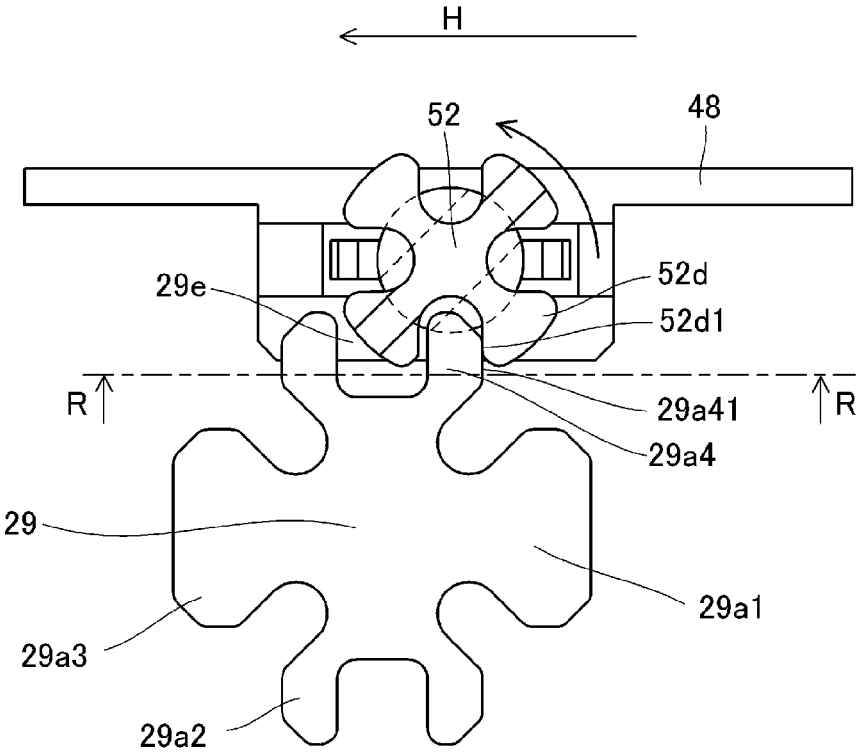
Figure 19:
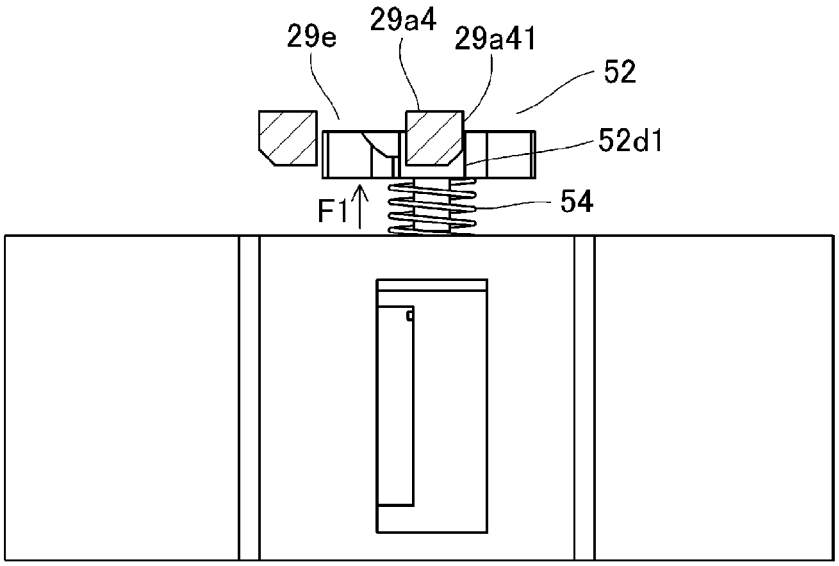

Parts (*a*) and (*b*) of FIG. 18 and (*a*) and (*b*) of FIG. 19 are illustrations showing an operation of a supply-side movable portion in a developer supply stop position.

Figure 20:
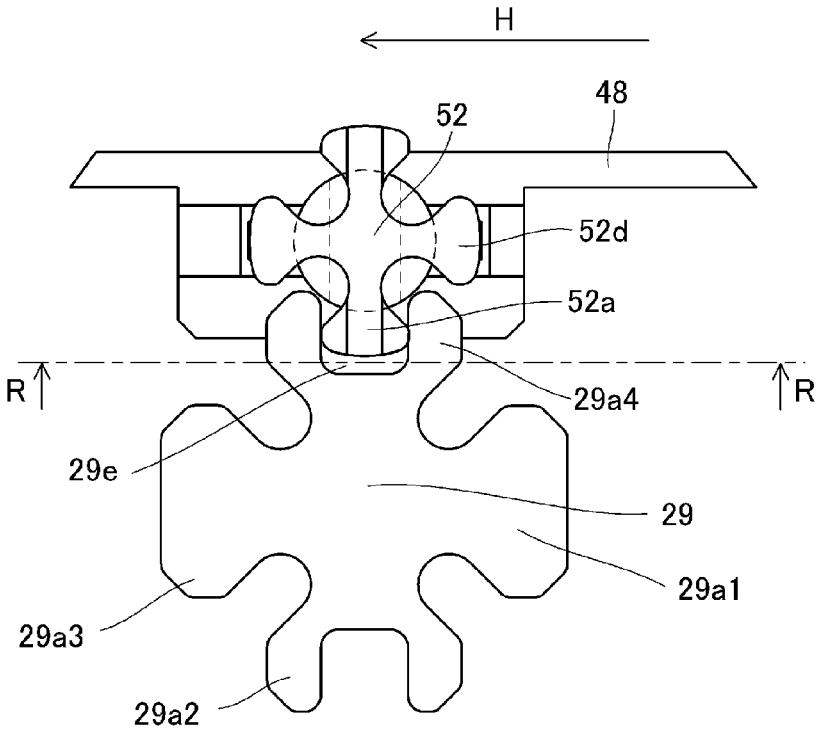
Figure 20:
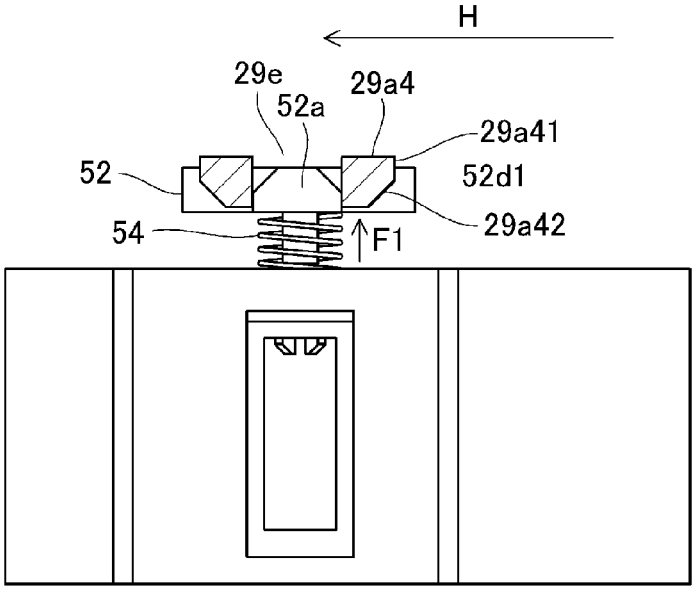

In FIG. 20, (*a*) and (*b*) are illustrations each showing an operation of the supply-side movable portion.

Figure 21:
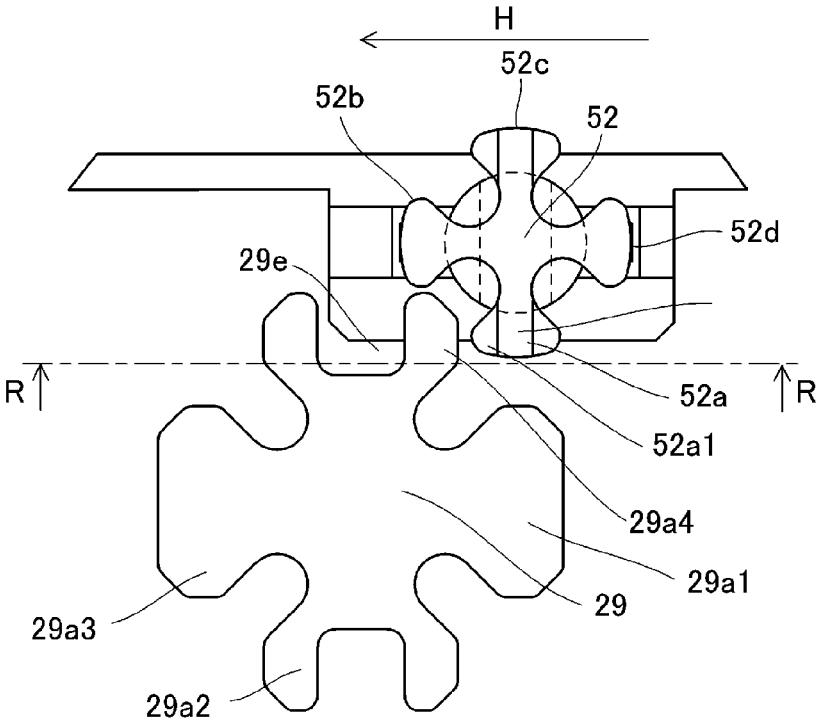
Figure 21:
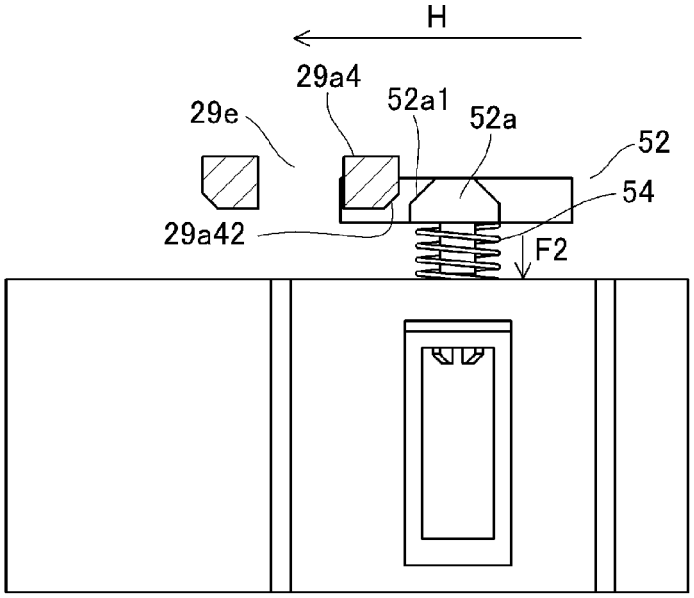
Figure 22:
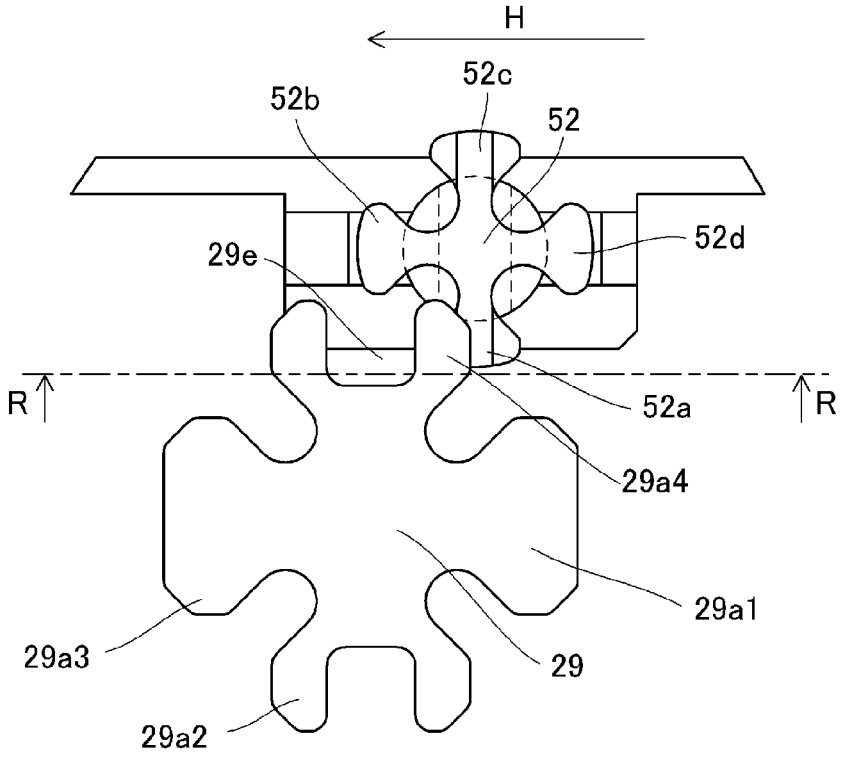
Figure 22:
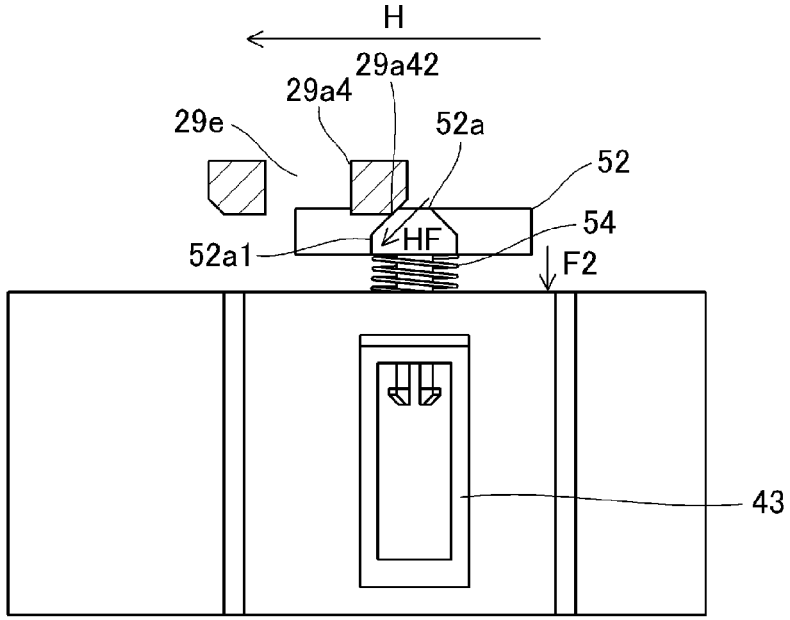
Figure 23:
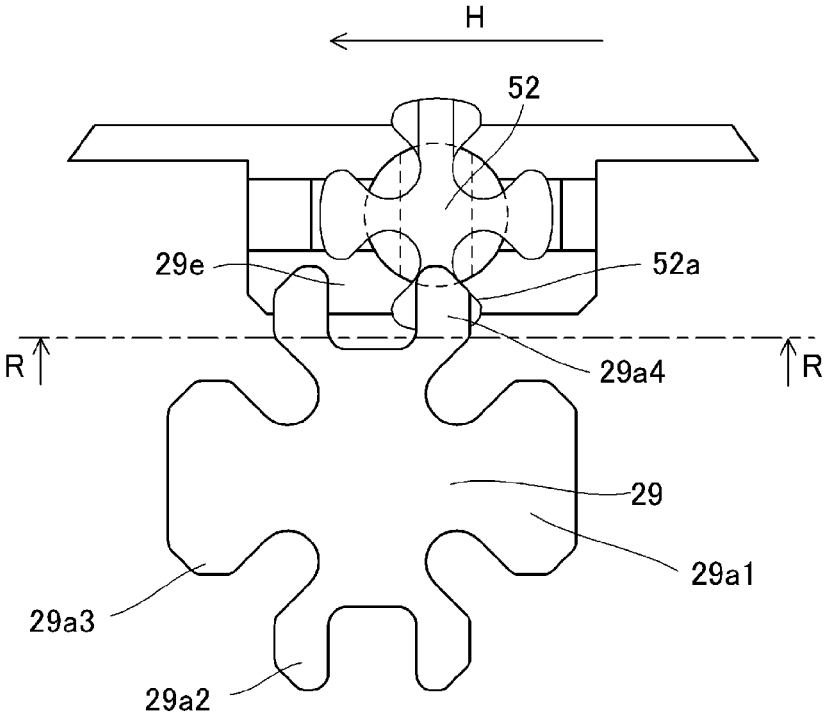
Figure 23:
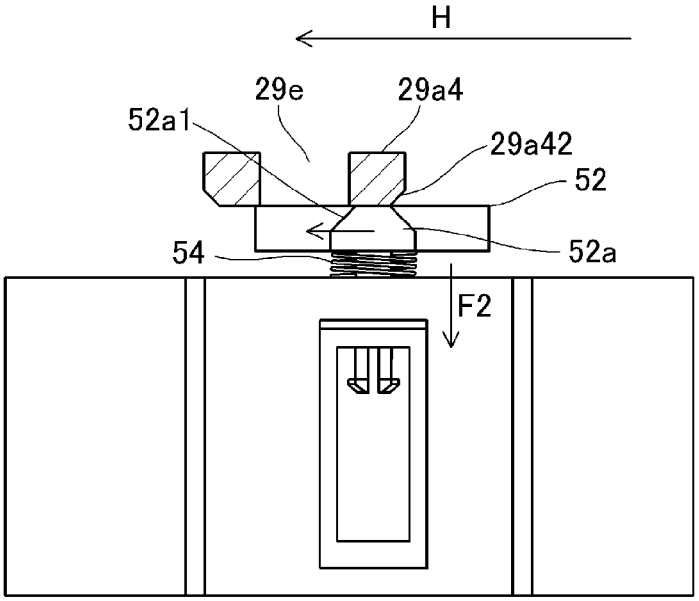

Parts (*a*) and (*b*) of FIG. 21, (*a*) and (*b*) of FIG. 22 and (*a*) and (*b*) of FIG. 23 are illustrations showing an operation of the developer supply-side shutter in an open state of a developer supply opening.

DESCRIPTION OF THE EMBODIMENTS

Embodiments of the present invention will be specifically described with reference to the drawings. However, dimensions, materials, shapes, relative arrangements and the like of constituent elements described in the following embodiments are appropriately changed depending on constitutions or various conditions of devices (apparatuses) to which the present invention is applied. That is, the scope of the present invention is not limited to the following embodiments.

Here, an electrophotographic image forming apparatus forms an image on a recording material with a developer (toner) by using an electrophotographic image forming process. Examples of the image forming apparatus may include an electrophotographic copying machine, an electrophotographic printer (LED printer, laser beam printer or the like), an electrophotographic facsimile machine, an electrophotographic word processor and the like.

Further, the recording material is a material on which the image is to be formed, and, i.e., is a paper sheet, an OHT sheet, or the like.

(Embodiment)

<General structure of image forming apparatus>

Figure 2:
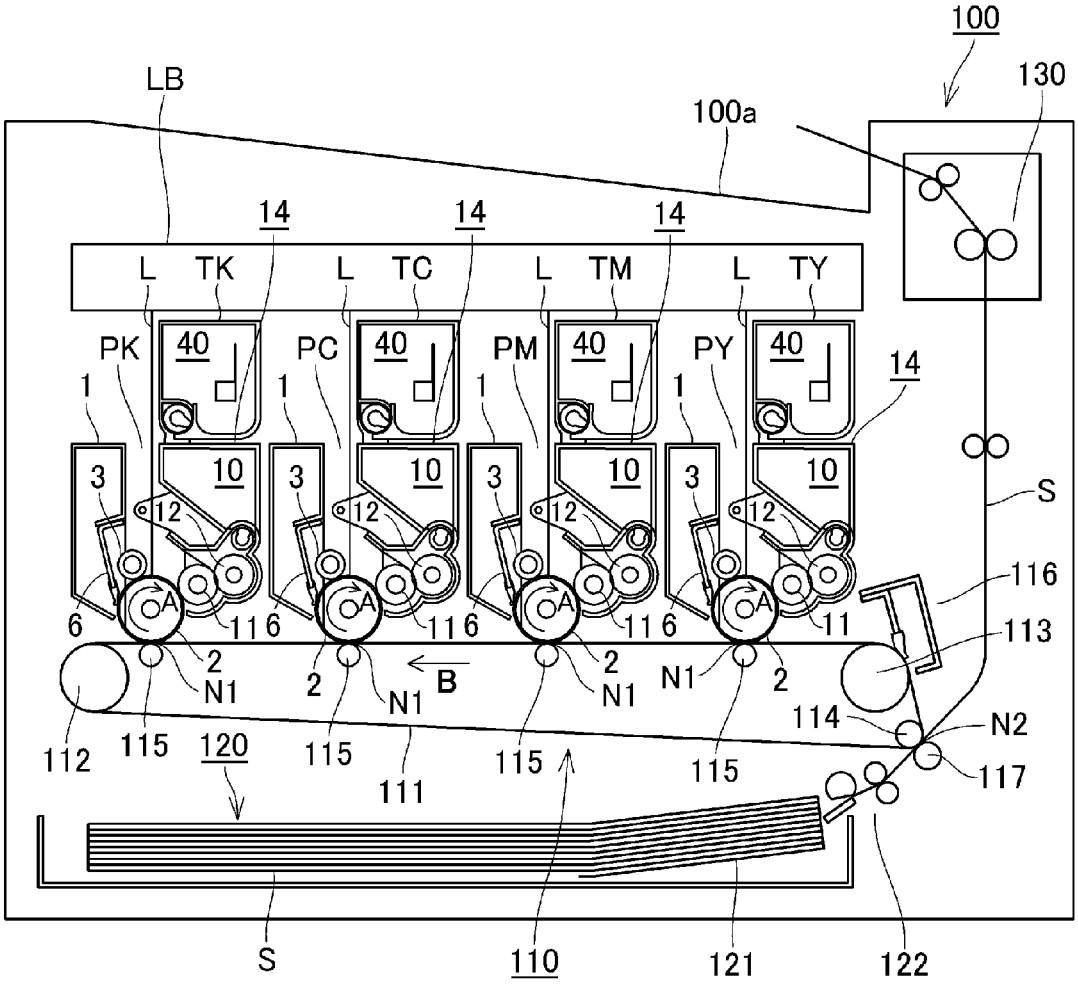
FIG. 2 is a schematic sectional view showing a structure of an image forming apparatus according to an embodiment of the present invention.
Figure 3:
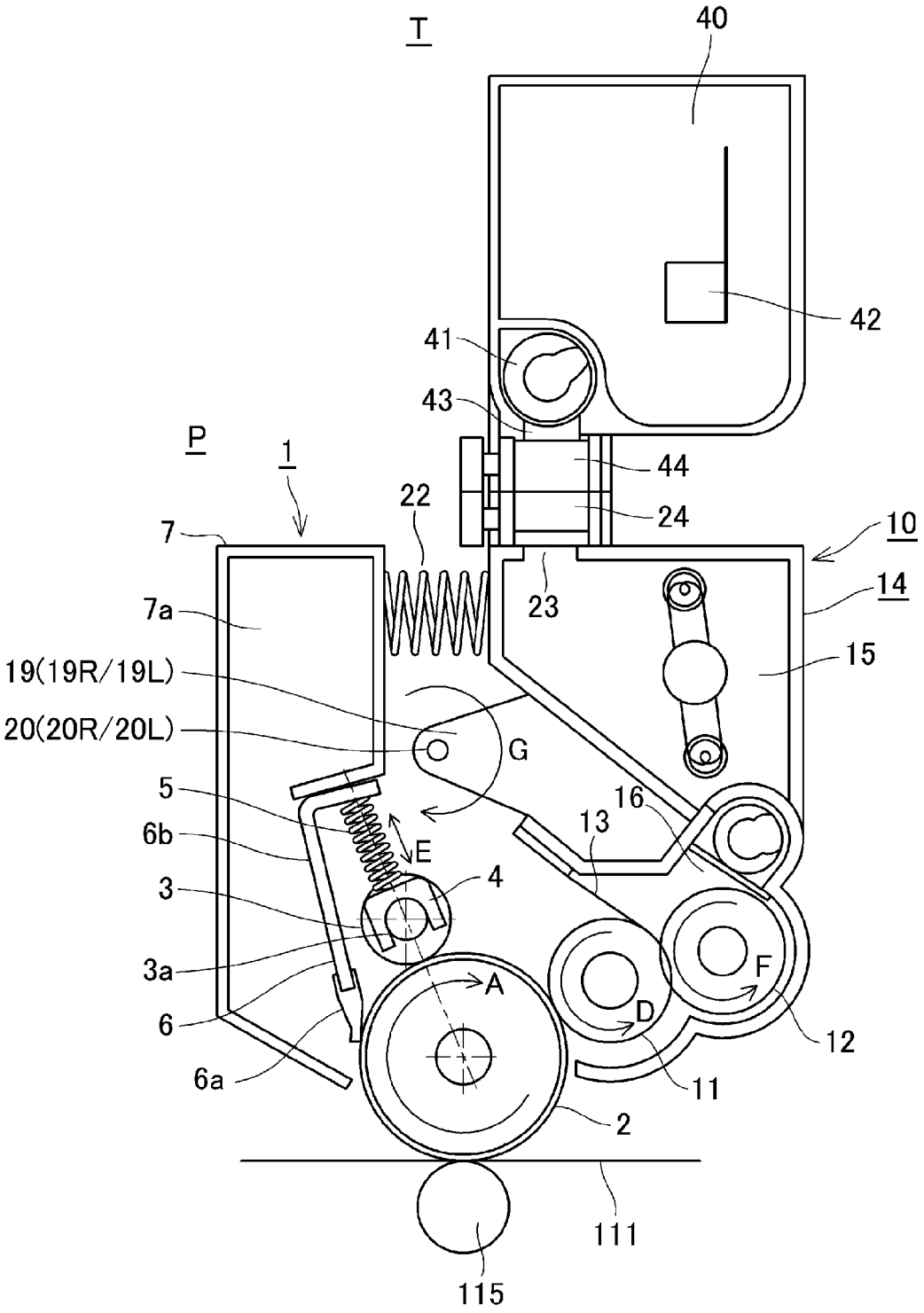
FIG. 3 is a schematic sectional view of a process cartridge and a developer supply cartridge.

A general structure of an image forming apparatus according to this embodiment of the present invention will be described with reference to FIGS. 2 and 3. FIG. 2 is a schematic sectional view showing a structure of the image forming apparatus according to this embodiment. FIG. 3 is a schematic sectional view showing structures of a process cartridge and a developer supply cartridge in this embodiment.

An image forming apparatus 100 shown in FIG. 2 is a four color-based full-color laser beam printer and forms a color image on a recording material S by using an electrophotographic process. The image forming apparatus 100 employs a so-called process cartridge type. That is, the image forming apparatus 100 according to this embodiment has a constitution in which a process cartridge P and a developer supply cartridge T are detachably mounted in an apparatus main assembly. In the following, the apparatus main assembly of the image forming apparatus refers to an apparatus constituent portion obtained by removing at least the process cartridge C and the developer supply cartridge T from a structure of the apparatus main assembly.

The apparatus main assembly 100 includes first to fourth process cartridges P (PY, PM, PC, PK) and first to fourth developer supply cartridges T (TY, TM, TC, TK) are provided and disposed in the horizontal direction.

The respective process cartridges P and the respective developer supply cartridges T have similar electrophotographic image forming process mechanisms and are different in color of developers and in filling amount of the developers. To each process cartridge P and each developer supply cartridge T, a rotational driving force is transmitted from the apparatus main assembly 100. Further, to each process cartridge P, a bias (charging bias, developing bias or the like) is applied from the apparatus main assembly 100. Each process cartridge P and each developer supply cartridge T are independently detachably mountable to the apparatus main assembly 100.

As shown in FIG. 3, each process cartridge P in this embodiment is constituted by a cleaning unit 1 and a developing unit 10. The cleaning unit 1 includes an electrophotographic photosensitive drum 2 as an image bearing member (hereinafter referred to as a photosensitive drum) and, as process means, a charging roller 3 and a cleaning member 6 which is actable on the photosensitive drum 2. The developing unit 10 includes a developing means for developing an electrostatic latent image formed on the photosensitive drum 1. The cleaning unit 1 and the developing unit 10 are swingably connected with each other.

The first process cartridge PY accommodates the developer of yellow (Y) in a receiving-side developer accommodating portion 15 and forms the developer image of yellow (Y) on the surface of the photosensitive drum 2. Similarly, the second process cartridge PM accommodates the developer of magenta (M), the third process cartridge PC accommodates the developer of cyan (C), and the fourth process cartridge PK accommodates the developer of black (K), in associated receiving-side developing accommodating portions 15.

On the other hand, the first developer supply cartridge TY accommodates the developer of yellow (Y) in a developer accommodating portion 40 and supplies the developer of Y to the process cartridge PY accommodating the developer of the same color. Similarly, the second developer supply cartridge TM accommodates the developer of magenta (M) and supplies the developer of M to the process cartridge PM accommodating the developer of the same color. Similarly, the third developer supply cartridge TC accommodates the developer of cyan (C) and supplies the developer of C to the process cartridge PC accommodating the developer of the same color. Similarly, the fourth developer supply cartridge TK accommodates the developer of black (K) and supplies the developer of K to the process cartridge PC accommodating the developer of the same color.

As shown in FIG. 3, the developer accommodating portion 40 of the developer supply cartridge T is provided with a developer supply opening 43 for permitting supply of the developer to the process cartridge P. The developer accommodating portion 15 of the process cartridge P is provided with a developer receiving opening 23 correspondingly to the developer supply opening 43. When the process cartridge P and the developer supply cartridge T are mounted in the apparatus main assembly 100, a developer supply-side shutter 44 and a developer receiving-side shutter 24 are in an open state. As a result, the developer supply opening 43 and the developer receiving opening 23 communicate with each other, so that the developer is supplied from the developer supply cartridge T to the process cartridge P. Incidentally, details of the process cartridge P and the developer supply cartridge T will be described later.

As shown in FIG. 2, above each of the cartridges P (PY, PM, PC, PK), a laser scanner unit LB as an exposure means is disposed. The laser scanner unit LB outputs laser light L correspondingly to image information. The surface of the photosensitive drum 2 is subjected to scanning exposure to the laser light L.

Further, under each process cartridge P (PY, PM, PC, PK), an intermediary transfer belt unit 110 as a primary transfer member is disposed. This intermediary transfer belt unit 110 includes a flexible endless transfer belt 111 and rollers, for stretching and rotating the transfer belt 111, consisting of a driving roller 112, a follower roller 113 and a secondary transfer opposite roller 114. The photosensitive drum 2 of each process cartridge P is contacted to the transfer belt 111. A contact portion N1 between the photosensitive drum 2 and the transfer belt 111 is a primary transfer portion. Inside the transfer belt 111, primary transfer rollers 115 are disposed opposed to the associated photosensitive drums 2. At a position opposing the secondary transfer opposite roller 114, a secondary transfer roller 117 as a secondary transfer member is disposed. A contact portion N2 between the transfer belt 111 and the secondary transfer roller 17 is a secondary transfer portion.

Below the intermediary transfer belt unit 110, a sheet feeding unit 120 is disposed. The sheet feeding unit 120 includes a sheet feeding tray 120 in which sheets of the recording material S are accommodated and includes a sheet feeding roller 122.

In an upper right side of the apparatus main assembly 100A, a fixing unit 130 is disposed. An upper surface of the apparatus main assembly 100A constitutes a sheet discharge tray 100*a*. Incidentally, the developer remaining on the transfer belt 111 without being transferred onto the recording material S is removed and collected by a belt cleaning unit 116 disposed in contact with the transfer belt 111.

<Image Forming Operation>

An operation for forming a full-color image by the image forming apparatus in this embodiment will be described with reference to FIG. 2. The photosensitive drums 2 of the first to fourth process cartridges P (PY, PM, PC, PK) are rotationally driven in an arrow A direction in FIG. 2 at a predetermined speed. The transfer belt 111 is rotationally driven in an arrow B direction (codirectionally with the photosensitive drums at their contact portions). At this time, a speed of the transfer belt 111 corresponds to the speed of the photosensitive drums 2. Similarly, the laser scanner unit LB is driven.

In synchronism with the drive of the laser scanner unit LB, the surface of the photosensitive drum 2 of each process cartridge P is uniformly charged to a predetermined polarity and a predetermined potential by the charging roller 3. The laser scanner unit LB scans and exposes the surface of each photosensitive drum 2 with the laser light L depending on an image signal for an associated color. As a result, an electrostatic latent image depending on the image signal for the associated color is formed on the surface of each photosensitive drum 2. The thus formed electrostatic latent image is developed by the developing roller 11.

By the above-described image forming operation, on the photosensitive drum 2 of the first process cartridge PY, a yellow (Y) developer image is formed. Then, the Y developer image is primary-transferred onto the transfer belt 111.

Similarly, the developer images of the second process cartridge PM, the third process cartridge PC and the fourth process cartridge PK are superposed on the transfer belt 111, so that unfixed toner images for a four color-based full-color image are formed.

On the other hand, with predetermined control timing, the recording material S accommodated in a feeding tray 121 is fed and introduced into the secondary transfer nip N2, in which the four color developer images superposed on the transfer belt 111 are collectively transferred onto the surface of the recording material S. The recording material S is then separated from the surface of the transfer belt 111 and then is introduced into the fixing unit 130. Then, the recording material S is heated and pressed at a fixing nip portion. As a result, the developer images are fixed on the recording material S. Thereafter, the recording material S already subjected to the fixing is conveyed onto the sheet discharge tray 100*a*, so that the full-color image forming operation is completed.

<General Structure of Process Cartridge>

Figure 4:
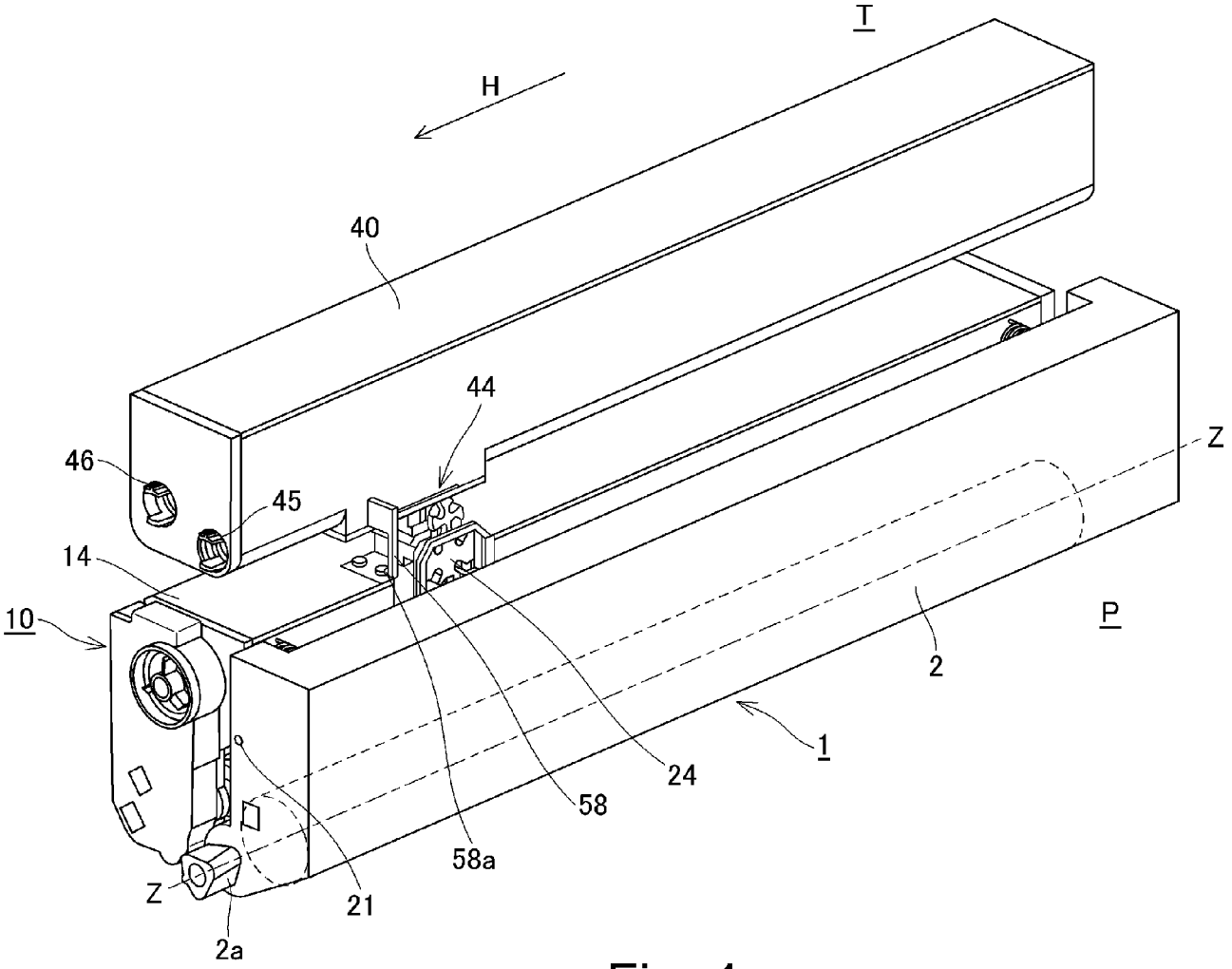
FIG. 4 is a perspective view of the process cartridge and the developer supply cartridge.
Figure 5:
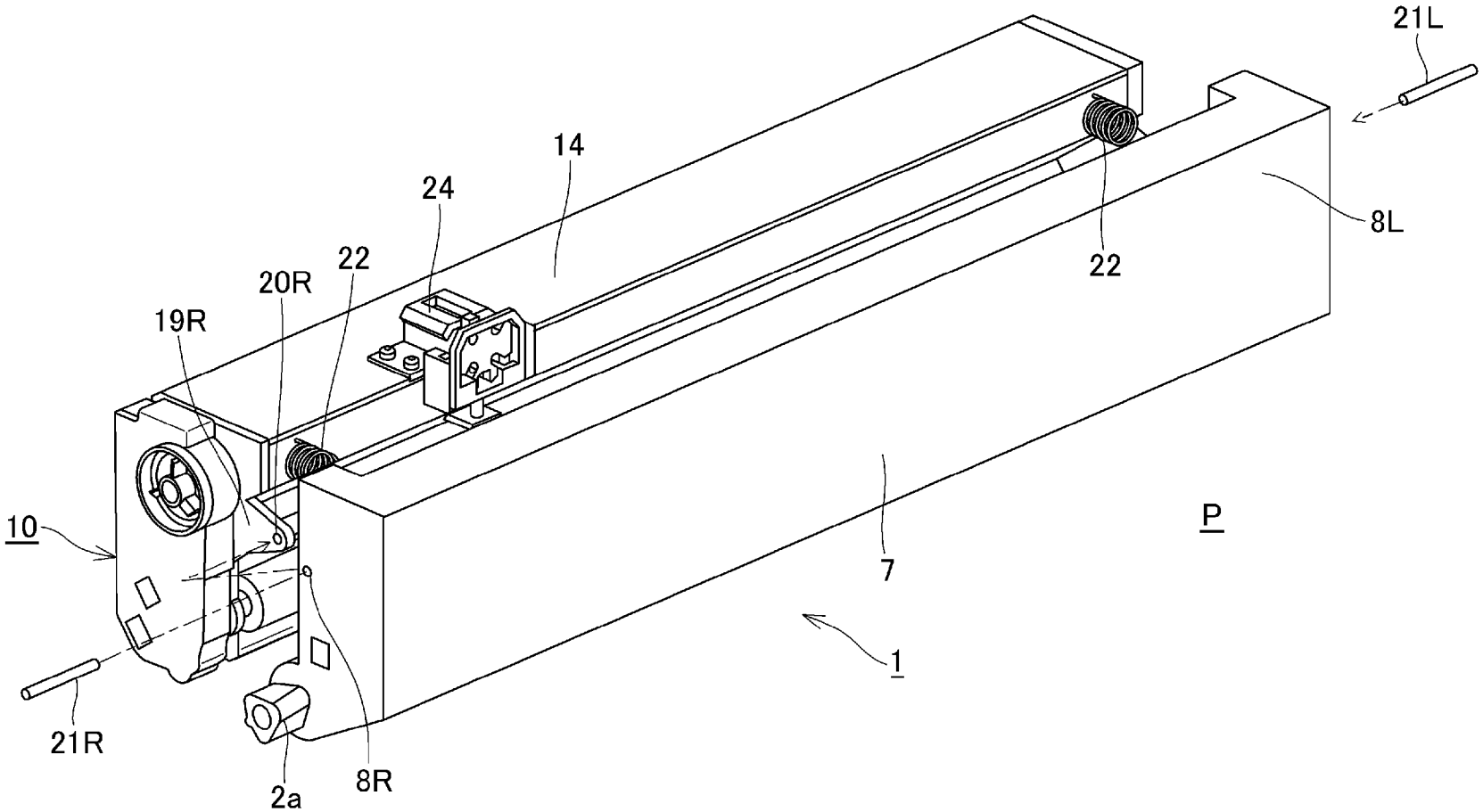
FIG. 5 is a perspective view of the process cartridge.

Next, a general structure of the process cartridge P will be described with reference to FIGS. 3 to 5. FIG. 4 is a perspective view showing structures of the process cartridge P and the developer supply cartridge T in this embodiment. FIG. 5 is a perspective view showing a structure of the process cartridge P.

As shown in FIG. 4, each process cartridge P (PY, PM, PC and PK) is an elongated assembly in which a rotational axis direction (axial direction) Z of the photosensitive drum 2 is a longitudinal direction. As described above, each process cartridge P is formed from the cleaning unit 1 and the developing unit 10. Incidentally, in the following description, the direction of the rotational axis Z of the photosensitive drum 2 is the longitudinal direction. The process cartridge P is inserted into the apparatus main assembly 100 in the longitudinal direction and thus is mounted in the apparatus main assembly 100.

[Cleaning Unit 1]

The cleaning unit 1 includes a cleaning (device) frame 7, the photosensitive drum 2, the charging roller 3 and the cleaning member 6.

The photosensitive drum 2 is rotatably supported by the cleaning frame 7. At one end of the photosensitive drum 2, as shown in FIG. 4, a drum driving coupling 2*a* is provided. The photosensitive drum 2 and the drum driving coupling 2*a* are integrally formed. The drum driving coupling 2*a* engages with a coupling (not shown) of the apparatus main assembly 100. A driving force of a driving motor (not shown) in the side of the apparatus main assembly 100A is transmitted to the drum driving coupling 2*a*, so that the photosensitive drum 2 is rotationally driven in the arrow A direction in FIG. 3 at the predetermined speed.

The charging roller 3 is rotated by the rotation of the photosensitive drum 2 while contacting the photosensitive drum 2. The charging roller 3 is, as shown in FIG. 3, mounted to the cleaning frame 7 via a charging roller bearing 4. The charging roller 3 is mounted movably in an arrow E direction along a line connecting the rotation center of the charging roller 3 and the rotation center of the photosensitive drum 2. The rotation shaft (metal shaft) 3*b* of the charging roller 3 is rotatably supported by the charging roller bearing 4. The charging roller bearing 4 is urged toward the photosensitive drum 2 by a charging roller pressing member (elastic urging member) 5.

The cleaning member 6 is constituted by an elastic rubber blade 6*a* at its end and a supporting metal plate 6*b*. The end of the elastic rubber blade 6*a* is contacted to the photosensitive drum 2 with respect to a counter direction to the rotational direction A of the photosensitive drum 2. The cleaning member 6 removes the developer remaining on the photosensitive drum 2. The developer removed from the peripheral surface of the photosensitive drum 2 is accommodated in a removed developer accommodating portion 7*a* of the cleaning frame 7.

[Developing Unit]

The developing unit 10 includes a developing (device) frame 14 for supporting respective elements in the developing unit 10 as shown in FIG. 3. The developing frame 14 is divided into a developing portion 16 and the receiving-side developer accommodating portion 15.

At the developing portion 16, a developing roller 11, a developer supplying roller 12 and a developing blade 13 are provided. The developing roller 11 is rotated in an arrow D direction while contacting the photosensitive drum 2.

The supplying roller 12 is rotated in an arrow F direction while contacting the developing roller 11. The supplying roller has two functions. One is to supply the developer onto the developing roller 11. The other is to peel off the developer remaining on the developing roller 11 without being subjected to development. The developing blade 13 regulates a layer thickness of the developer by contacting a peripheral surface of the developing roller 11.

On the other hand, the receiving-side developer accommodating portion 15 accommodates the developer supplied from the developer supply cartridge T. The receiving-side developer accommodating portion 15 is provided with the developer receiving opening 23. At an upper portion of the receiving-side developer accommodating portion 15, the developer receiving-side shutter 24 is disposed. In general, the developer receiving-side shutter 24 is in a state in which the developer receiving opening 23 is closed. Further, in a state in which the process cartridge P and the developer supply cartridge T are mounted in the apparatus main assembly 100. Details of the developer receiving-side shutter 24 will be described later.

[Connection Between Cleaning Unit 1 and Developing Unit 10]

As shown in FIG. 5, the cleaning frame 7 includes connecting holes 8 (8R, 8L). The developing frame 14 is, as shown in FIGS. 3 and 5, provided with development side plates 19 (19R, 19L) at longitudinal ends thereof. The developing side plates 19 (19R, 19L) are provided with development connecting holes 20 (20R, 20L). The cleaning connecting hole 8 (8R, 8L) and the development connecting hole 20 (20R, 20L) are, as shown in FIG. 5, engaged with connecting shafts 21 (21R, 21L) to be swingably connected. As a result, the cleaning unit 1 and the developing unit 10 are connected.

Between the cleaning unit 1 and the developing unit 10, as shown in FIGS. 3 and 5, a pressing spring 22 is disposed. By an urging force of the pressing spring 22, the developing unit 10 obtains rotation moment about the development connecting holes 20 as the center. As a result, the developing roller 11 contacts the photosensitive drum 2. In this embodiment, the developing roller 11 is disposed in contact with the photosensitive drum 2 but may also be constituted to be disposed with a predetermined spacing.

[Structure of Developer Receiving-side Shutter 24]

Next, with reference to FIGS. 6 to 10, a structure of the developer receiving-side shutter 24 will be described.

Figure 6:
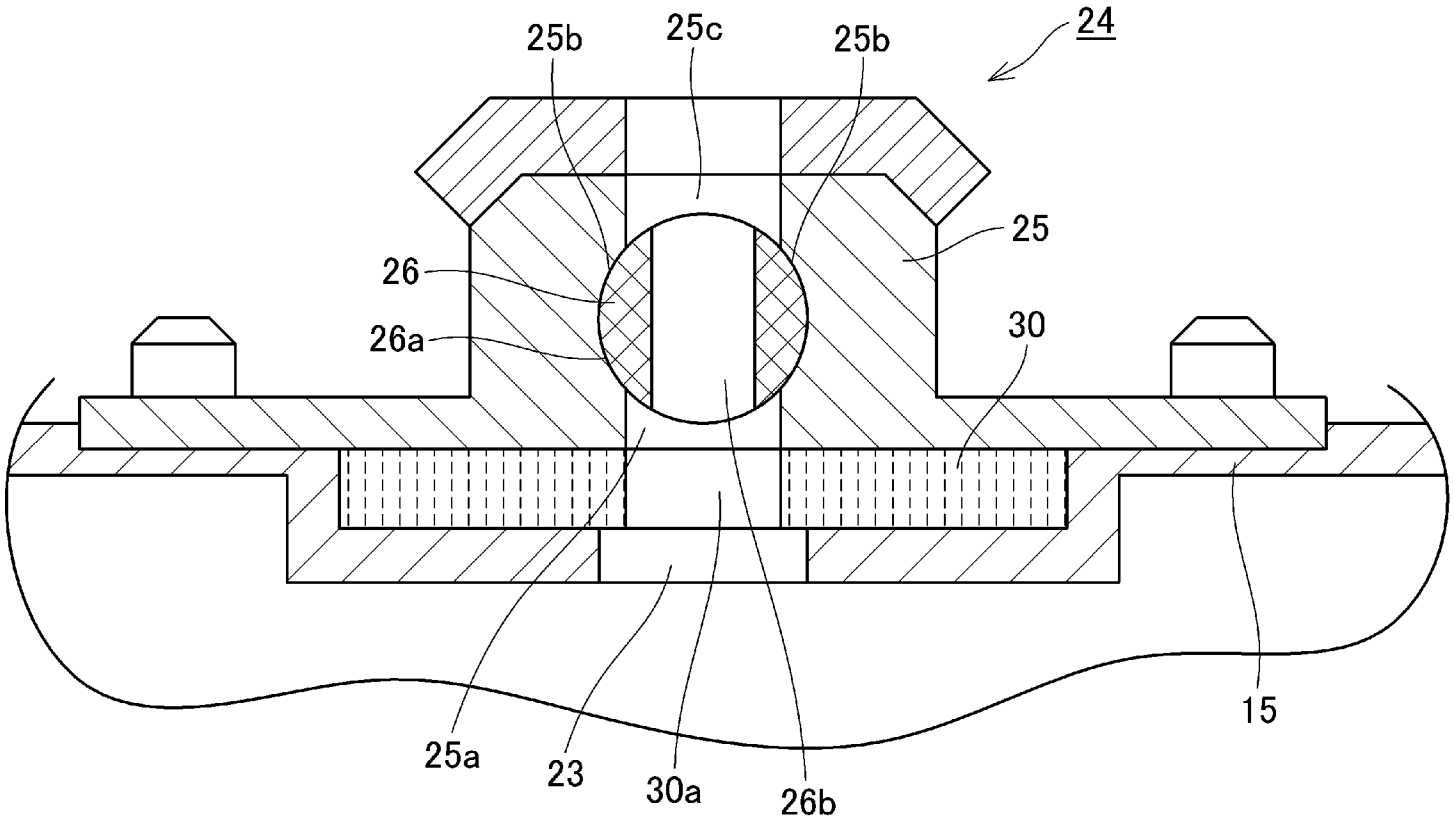
FIG. 6 is a schematic sectional view showing a developer receiving permitting state of a developer receiving-side shutter.
Figure 7:
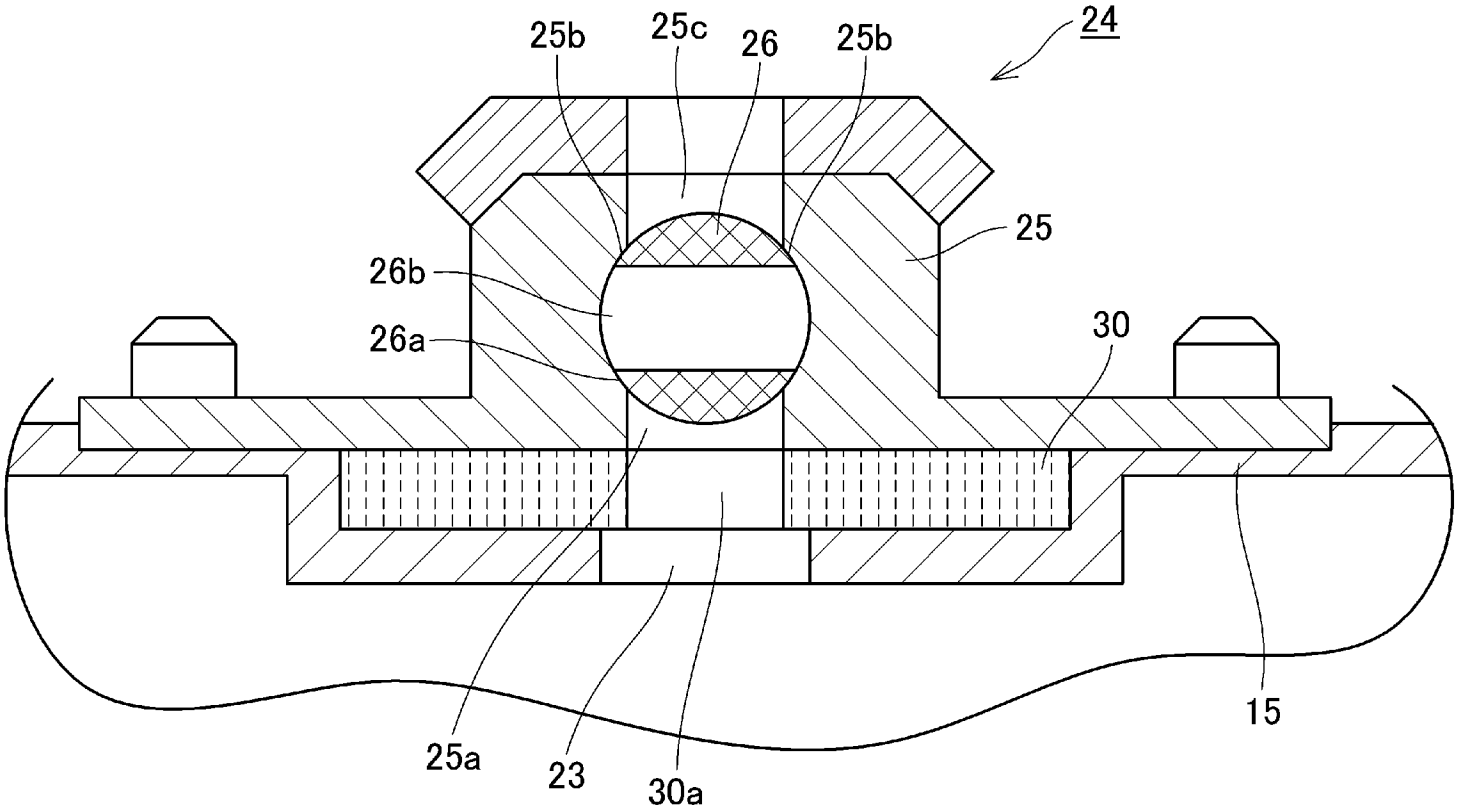
FIG. 7 is a schematic sectional view showing a developer receiving stop state of the developer receiving-side shutter.
Figure 8:
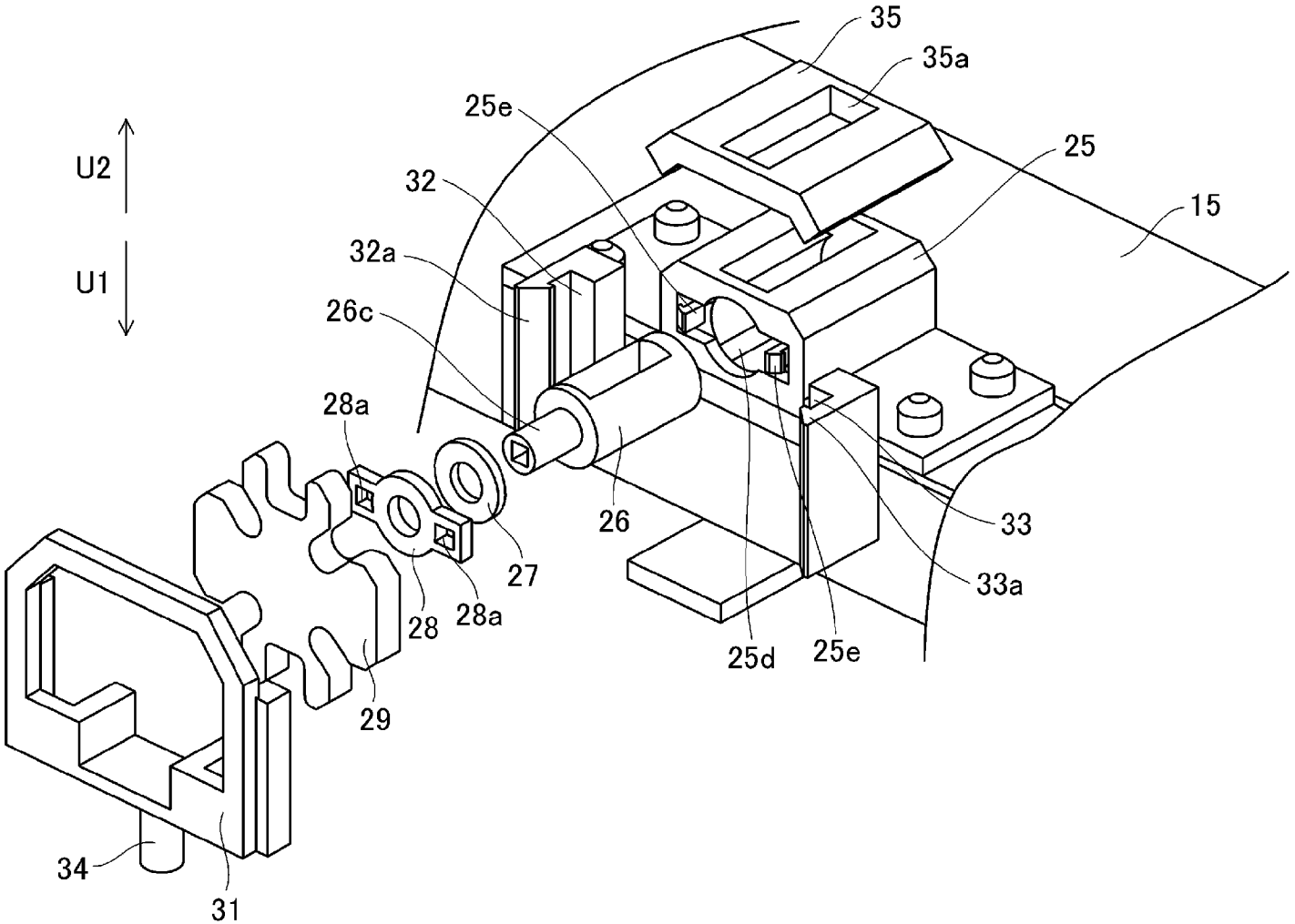
FIG. 8 is an exploded perspective view showing an assembling structure of the developer receiving-side.
Figure 9:
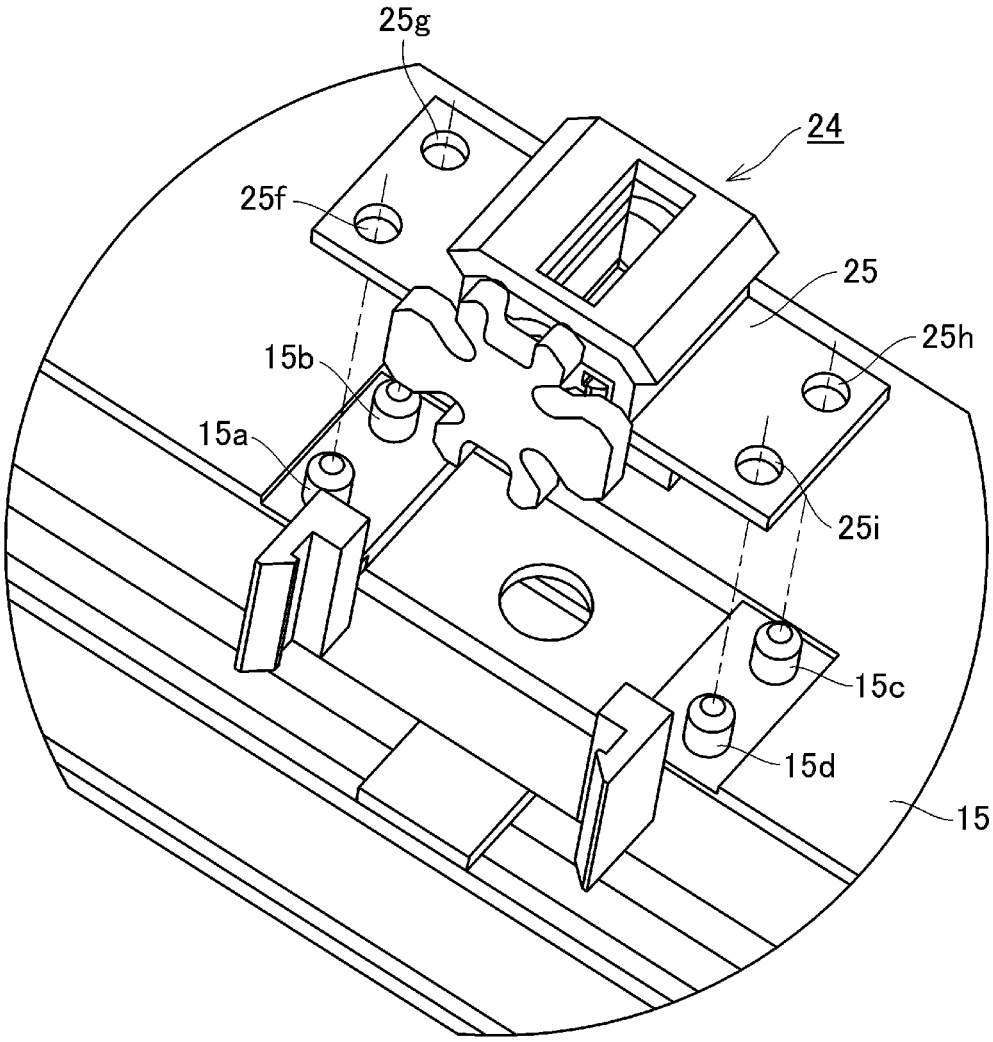
FIG. 9 is an exploded perspective view showing a connecting portion between the developer receiving-side shutter and a receiving-side developer accommodating portion.
Figure 10:
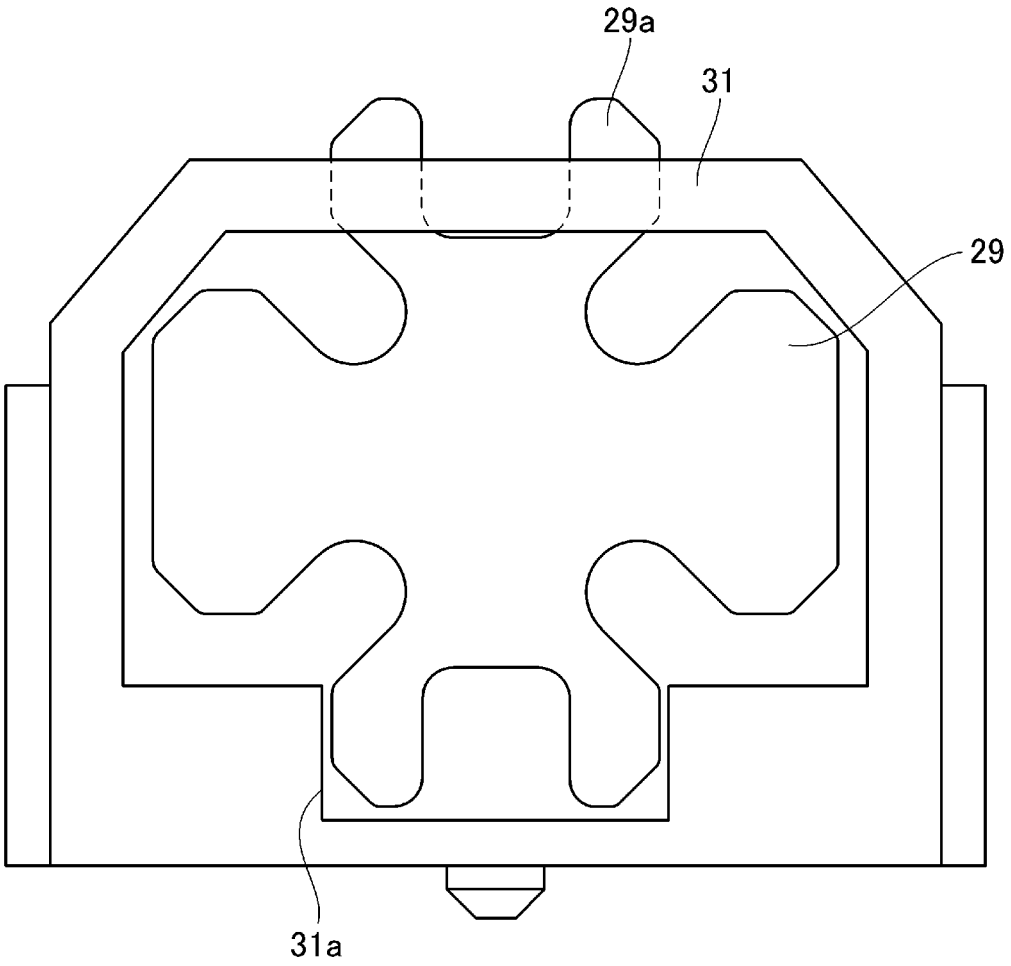
FIG. 10 is a schematic view for illustrating a structure of a limiting member.

FIG. 6 is a schematic sectional view showing a developer receiving permitting state of a developer receiving-side shutter. FIG. 7 is a schematic sectional view showing a developer receiving stop state of the developer receiving-side shutter. FIG. 8 is an exploded perspective view showing an assembling structure of the developer receiving-side. FIG. 9 is an exploded perspective view showing a structure of a connecting portion between the developer shutter and a receiving-side developer accommodating portion. FIG. 10 is a schematic view for illustrating a structure of a limiting member.

As shown in FIG. 6, the developer receiving-side 24 as a receiving-side shutter mechanism in this embodiment roughly includes a receiving-side shutter frame 25 and a receiving rotatable member 26 as a receiving-side shutter portion.

The receiving-side shutter frame 25 is provided with a through hole including a first opening 25*a* and a second opening 25*c* and with a bearing portion 25*b* as an arcuate surface provided in the through hole. The first opening 25*a* is provided correspondingly to the developer supply opening 23 provided in the receiving-side developer accommodating portion 15.

The receiving rotatable member 26 has a cylindrical outer configuration and is disposed in the through hole of the receiving shutter frame 25. Specifically, the receiving rotatable member 26 is supported at an outer peripheral surface 26*a* thereof by the bearing portion 25*b* of the receiving shutter frame 25 and is constituted rotatably relative to the receiving shutter frame 25. Further, the receiving rotatable member 26 is provided with a through hole 26*b* which opens at the outer peripheral surface 26*a*. A rotation shaft of the receiving rotatable member 26 is set in a direction perpendicular to the through hole of the receiving shutter frame 25, and this direction is also a direction perpendicular to a movement during the mounting of each cartridge P.

The receiving rotatable member 26 is, when being positioned in a phase shown in FIG. 6, in a state in which the first opening 25*a* side and the second opening 25*c* side of the through hole of the receiving shutter frame 25 are caused to communicate with each other by the through hole 26*b*. This state is a state in which the developer receiving opening 23 of the receiving-side developer accommodating portion 15 is open to the outside, i.e., a state in which the developer supplied from the developer supply cartridge T can be received. A position (phase) of the receiving rotatable member 26 at this time is a developer receiving permitting position (open position).

The receiving rotatable member 26 is, when being positioned in a phase of FIG. 7, i.e., positioned in a position which is rotated from the developer receiving permitting position shown in FIG. 6 by 90 degrees, in a state in which the through hole of the receiving shutter frame 25 is closed (blocked). This state is a state in which the developer receiving opening 23 of the receiving-side developer accommodating portion 15 is closed with respect to the outside, and a position (phase) of the receiving rotatable member 26 at this time is a developer receiving stop position (closed position).

[Assembling of Developer Receiving-side Shutter 24]

As shown in FIG. 8, to a mounting portion 25*d* of the receiving shutter frame 25, the receiving rotatable member 26, a receiving rotatable seal member 27 and a receiving shutter frame cover 28 are mounted. The receiving shutter frame 25 and the receiving shutter cover 28 are connected by hooking a mounting hole 28*a* of the receiving shutter frame cover 28 on a claw portion 25*e* of the receiving shutter frame 25. After the receiving shutter frame cover 28 is assembled, a receiving-side movable portion 29 is mounted at an end of a shaft portion 26*c* of the receiving rotatable member 26 by press-fitting. The receiving rotatable member 26 and the receiving-side movable portion 29 are integrally rotated by a rotation stopper. The receiving-side movable portion 29 has four projected portions 29*a* (29*a*1, 29*a*2, 29*a*3, 29*a*4).

As shown in FIG. 6, a receiving seal member 30 is provided between the receiving-side developer accommodating portion 15 and the receiving shutter frame 25. The receiving seal member 30 performs the function of preventing toner leakage from the connecting surface between the receiving-side developer accommodating portion 15 and the receiving shutter frame 25. Incidentally, the receiving seal member 30 is provided with a through hole 30*a* correspondingly to the developer receiving opening 23.

As shown in FIG. 9, the developer receiving shutter 24 includes the receiving-side shutter frame 25 provided with positioning holes 25*f*, 25*g*, 25*h* and 25*i*, and on the other hand, the receiving-side developer accommodating portion 15 is provided with positioning shafts 15*a*, 15*b*, 15*c* and 15*d*. The mounting of the developer receiving shutter 24 to the receiving-side developer accommodating portion 15 is performed by engaging the positioning holes 25*f*-25*i* of the developer shutter frame 25 with the positioning shafts 15*a*-15*d* of the receiving-side developer accommodating portion 15 to position the developer shutter frame 25 and then by thermally caulking ends of the positioning shafts 15*a*-15*d*. As a result, the developer receiving shutter 24 is fixed on the receiving-side developer accommodating portion 15.

Further, as shown in FIG. 8, the receiving side developer accommodating portion 15 is provided with a limiting member 31 for limiting rotation of the receiving side movable portion 29. The limiting member 31 is provided movably in an up down direction (arrow U1 and U2 directions) by claw portions 32*a* and 33*a* of slide rails 32 and 33 provided in the receiving side developer accommodating portion 15. Further, the limiting member 31 is always urged upward (in U2 direction) by an elastic force of a compression spring 34 provided between the receiving side developer accommodating portion 15 and the limiting member 31. A position in this state is a home position (hereinafter referred to as a limiting position) of the limiting member 31. As shown in FIG. 10, in the limiting position, a limiting recessed portion 31 a provided in the limiting member 31 and the projected portion 29*a* of the receiving side movable portion 29 are engaged with each other. As a result, the rotation of the receiving side movable portion is limited. Further, a state shown in FIG. 10 is, as shown in FIG. 6, a state in which the receiving rotatable member 26 is positioned in the developer supply permitting position.

Incidentally, as shown in FIG. 8, at an uppermost surface of the receiving shutter frame 25, a frame seal member 35 is provided. The frame seal member 35 is provided with an opening 35*a* correspondingly to the second opening 25*c* of the receiving shutter frame 25.

[General Structure of Developer Supply Cartridge T]

Figure 11:
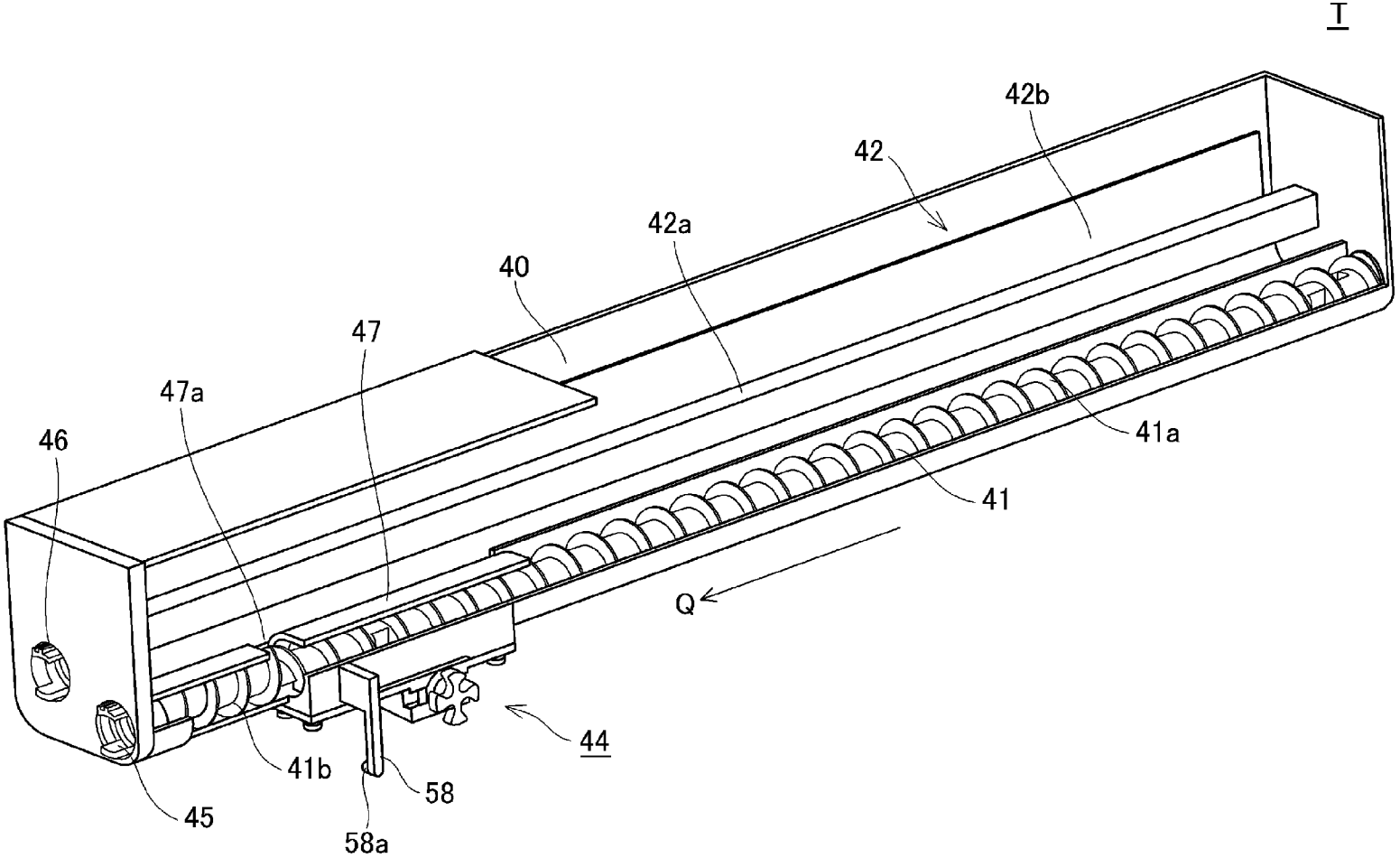
FIG. 11 is a perspective view showing a structure of the developer supply cartridge.

With reference to FIGS. 3, 4 and 11, a general structure of the developer supply cartridge T in this embodiment will be described. FIG. 11 is a perspective view showing a structure of the developer supply cartridge T, and in order to show an inside structure, a part of a housing is omitted and illustrated.

As shown in FIG. 3, the developer supply cartridge T includes the developer accommodating portion 40. The developer accommodating portion 40 is provided with the developer supply opening 43 for permitting supply of the developer to the process cartridge P. At a lower portion (outside) of the developer supply opening 43, the developer supply-side shutter 44 as a supply-side shutter mechanism is provided. The developer supply-side shutter 44 is in the developer supply stop state in which the developer supply opening 43 is closed (blocked) in a state in which the developer supply cartridge (toner cartridge) T is unmounted in the apparatus main assembly 100. Further, in a state in which the process cartridge P and the developer supply cartridge T are mounted in the apparatus main assembly 100, the developer supply shutter 44 is in the developer supply permitting state in which the developer supply opening 43 is open. Details of the developer supply-side shutter 44 will be described later.

As shown in FIG. 4, when the developer supply cartridge T is mounted in the apparatus main assembly 100, the developer supply cartridge T is moved into the apparatus main assembly 100 in an arrow H direction (longitudinal direction). The developer supply cartridge T is provided with an engaging member 58 as a driving means downstream of the developer supply side shutter 44 with respect to this movement (entrance) direction. An engaging portion 58*a* of the engaging member 58 is used for opening and closing the developer receiving side shutter 24. Details of an opening and closing operation of the developer supply side shutter 44 will be described later.

As shown in FIG. 11, inside the developer accommodating portion 40, a supply feeding member 41 and a supply stirring member 42 are provided. The supply feeding member 41 and the supply stirring member 42 are rotatably supported by the developer accommodating portion 40.

The supply feeding member 41 feeds the developer in the developer accommodating portion 40 toward the developer supply opening 43 by rotation thereof. The supply feeding member 41, as shown in FIG. 11, is a screw member provided at a surface thereof with a helical fin 41*a* and a returning fin 41*b*. The helical fin 41*a* feeds the developer in an arrow Q direction (longitudinal direction). The returning fin 41*b* feeds the developer in an opposite direction to the feeding direction of the helical fin 41*a*. Above the supply feeding member 41, a cover member 47 is provided. The cover member 47 covers a part of the developer supply opening 43 and the supply feeding member 41 with respect to the longitudinal direction. The cover member 47 is provided with a returning hole 47*a*.

The supply stirring member 42 has two functions. One is to stir the developer in the supply frame 40. The other is to feed the stirred developer to the supply feeding member 41. The supply stirring member 42 is constituted by a supply stirring portion 42*a* and a supply stirring sheet 42*b*.

At a longitudinal end of the supply feeding member 41 and the supply stirring member 42, a supply feeding coupling 45 and a supply stirring coupling 46 are provided, respectively. The supply feeding coupling 45 and the supply stirring coupling 46 are engaged with couplings (not shown) of the apparatus main assembly 100. A driving force of a driving motor (not shown) of the apparatus main assembly 100 is transmitted to the supply feeding coupling 45 and the supply stirring coupling 46, so that the supply feeding member 41 and the supply stirring member 42 are rotationally driven at a predetermined speed.

[Feeding of Developer in Developer Supply Cartridge I]

The developer in the developer accommodating portion 40 is stirred by the supply stirring member 42 and fed to the supply feeding member 41. The developer fed to the supply feeding member 41 is partly limited by the cover member 47 when being fed to the cover member 47. As a result, an amount of the developer discharged through the developer supply opening 43 becomes constant. The developer fed into the cover member 47 is discharged into the process cartridge P through the developer supply opening 43. The developer which is not discharged through the developer supply opening 43 is fed back to the supply stirring member 41 through the returning hole 47*a* by the returning fin 41*b* and then is stirred again.

[Structure of Developer Supply-Side Shutter 44]

Figure 1:
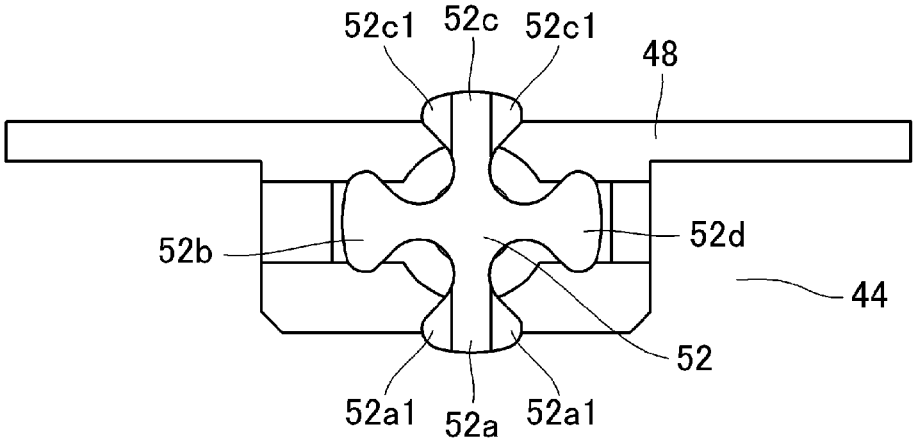
In FIG. 1, (*a*) and (*b*) are illustrations each showing a phase of a supply-side movable portion in a developer supply permitting position.
Figure 1:
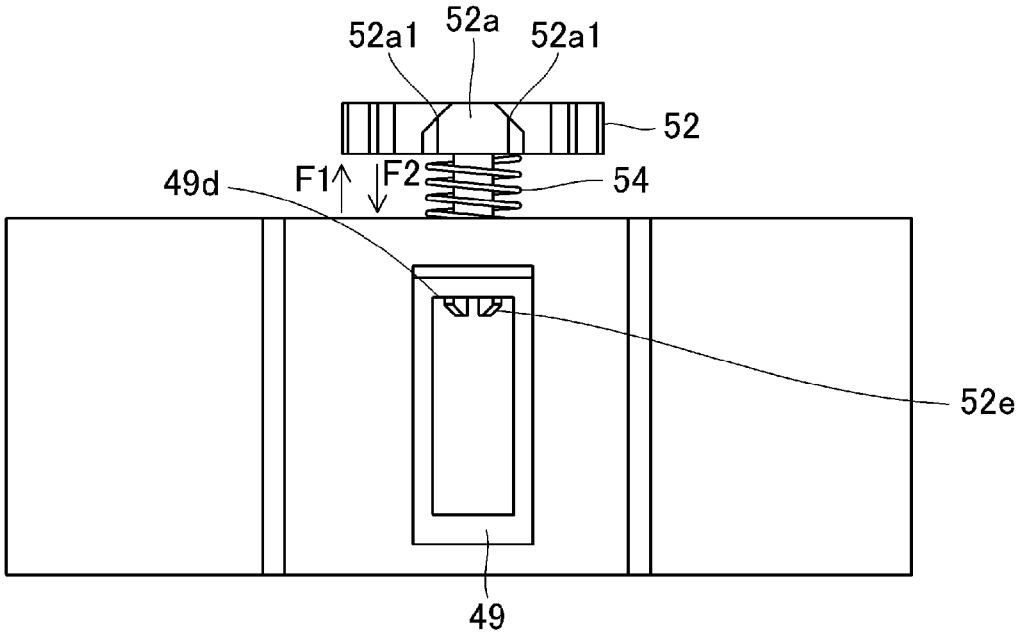
Figure 12:
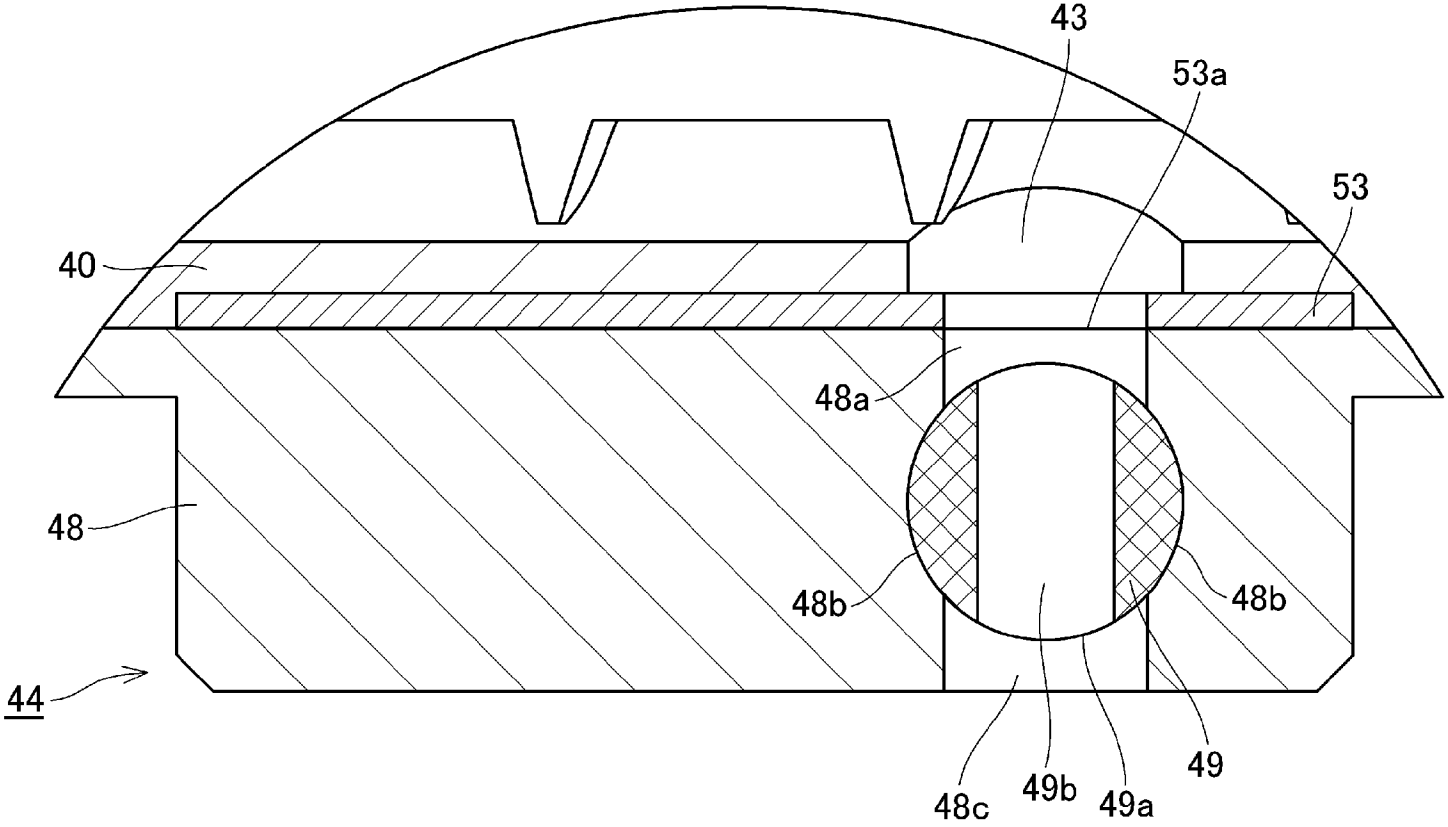
FIG. 12 is a schematic sectional view showing a developer supply permitting state of a developer supply-side shutter.
Figure 13:
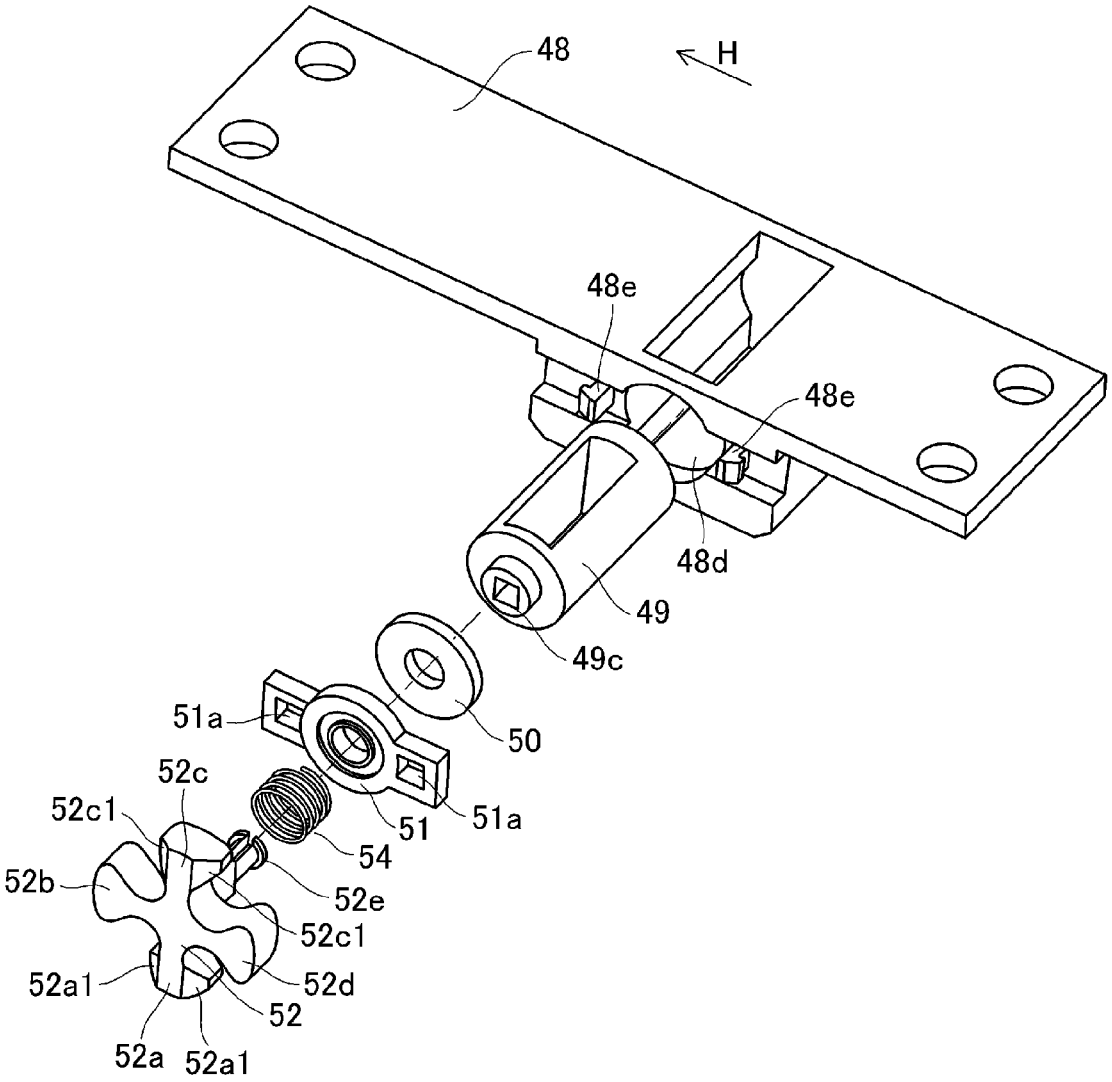
FIG. 13 is an exploded perspective view showing an assembling structure of the developer supply-side shutter.
Figure 14:
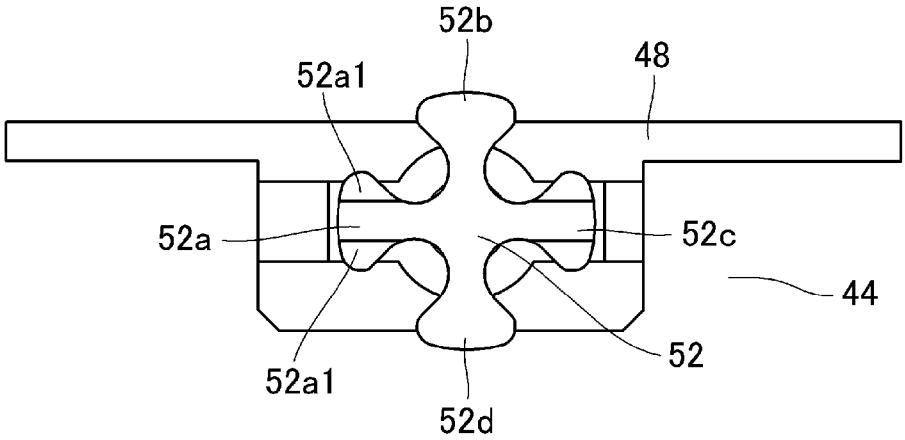
In FIG. 14, (*a*) and (*b*) are illustrations each showing a phase of a supply-side movable portion in a developer supply permitting position.
Figure 14:
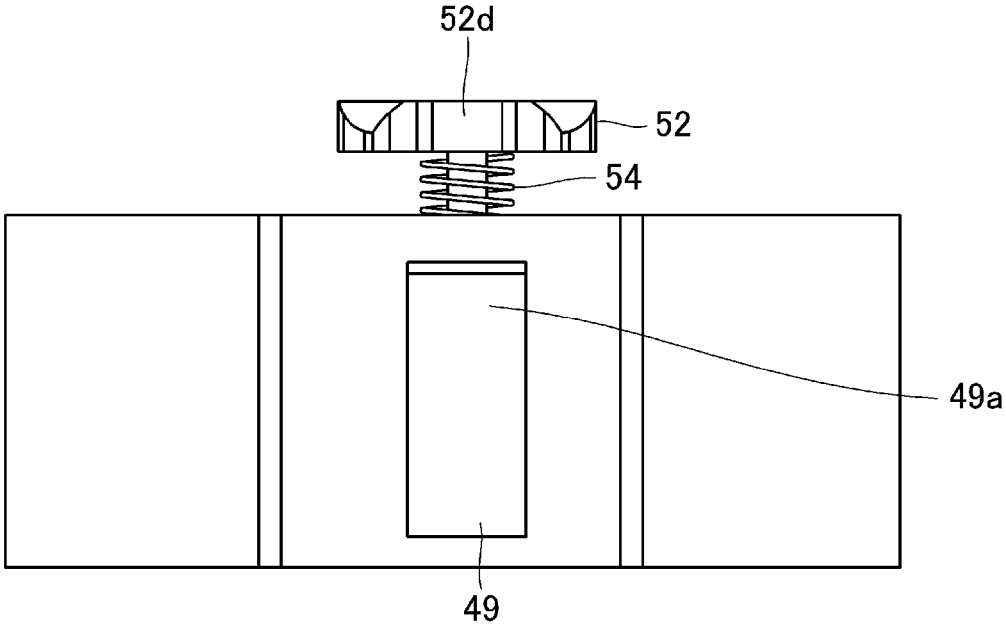

With reference to FIGS. 1, 7, 12 to 14, a structure of the developer supply-side shutter 44 will be specifically described. In FIG. 1, (*a*) and (*b*) are illustrations each showing a phase of the supply-side movable portion in the developer supply permitting position, in which (*a*) is a schematic view of the developer supply-side shutter as seen in the rotational axis direction of the supply-side movable portion, and (*b*) is a bottom view of the supply-side movable portion when (*a*) is a front view of the supply-side movable portion. FIG. 12 is a schematic sectional view showing the developer supply permitting state of the developer supply-side shutter 44. FIG. 13 is an exploded perspective view showing an assembling structure of the developer supply-side shutter 44. In FIG. 14, (*a*) and (*b*) are illustrations each showing a phase of the supply-side movable portion in the developer supply stop position, in which (*a*) is a schematic view of the developer supply-side shutter as seen in the rotational axis direction of the supply-side movable portion, and (*b*) is a bottom view of the supply-side movable portion when (*a*) is a front view of the supply-side movable portion.

As shown in FIG. 12, the developer supply-side shutter 44 as a supply side shutter mechanism in this embodiment roughly includes a supply shutter frame 48 and a rotatable supply member 49 as a supply side shutter portion.

The supply-side shutter frame 48 is provided with a through hole including a first opening 48*a* and a second opening 48*c* and with a bearing portion 48*b* as an arcuate surface provided in the through hole. The second opening 48*c* is provided correspondingly to the second opening 25*c* of the receiving shutter frame 25 of the developer receiving-side shutter 24 mounted to the receiving-side developer accommodating portion 15 of the developing unit 10.

The rotatable supply member 49 has a cylindrical outer configuration and is disposed in the through hole of the supply shutter frame 48. Specifically, the rotatable supply member 49 is supported at an outer peripheral surface 49*a* thereof by the bearing portion 48*b* of the supply shutter frame 48 and is constituted rotatably relative to the supply shutter frame 48. Further, the rotatable supply member 49 is provided with a through hole 49*b* which opens at the outer peripheral surface 49*a*. A rotation shaft of the rotatable supply member 49 is set in a direction perpendicular to the through hole of the supply shutter frame 48, and this direction is also a direction perpendicular to a movement during the mounting of each cartridge P.

The rotatable supply member 49 is, when being positioned in a phase shown in FIG. 12, in a state in which the first opening 48*a* side and the second opening 48*c* side of the through hole of the supply shutter frame 48 are caused to communicate with each other by the through hole 49*b*. This state is a state in which the developer supply opening 43 of the supply-side developer accommodating portion 40 is open to the outside, i.e., a state in which the developer can be supplied to the process cartridge P. A position (phase) of the rotatable supply member 49 at this time is a developer supply permitting position (open position).

The rotatable supply member 49 is, when being positioned in a position which is rotated from the developer receiving permitting position shown in FIG. 12 by 90 degrees, i.e., positioned in the same phase as the receiving rotatable member 26 shown in FIG. 7, in a state in which the through hole of the supply shutter frame 48 is closed (blocked). This state is a state in which the developer supply opening 43 of the supply-side developer accommodating portion 40 is closed with respect to the outside, and a position (phase) of the rotatable supply member 49 at this time is a developer supply stop position (closed position).

[Assembling of Developer Supply-side Shutter 44]

As shown in FIG. 13, to a mounting portion 48*d* of the supply shutter frame 48, the supply rotatable member 49, a supply rotatable seal member 50 and a supply shutter frame cover 51 are mounted. The supply shutter frame 48 and the supply shutter cover 51 are connected by hooking a mounting hole 51*a* of the supply shutter frame cover 51 on a claw portion 48*e* of the supply shutter frame 48. Further, a supply-side movable portion 52 is mounted in a state in which an urging member 54 is engaged in a spring seat portion 51*b* of the supply shutter frame cover 51. The supply-side movable portion 52 is connected by penetrating a shaft portion having an end claw portion 52*e* into a hole 49*c* of the rotatable supply member 49 and then by hooking the claw portion 52*e* on a claw receiving portion 49*d* of the through hole 49*b* (FIG. 1). The shaft portion of the supply-side movable portion 52 has a prismatic shape corresponding to a rectangular cross section of the hole 49*c*, so that only movement of the supply-side movable portion 52 in the axial direction relative to the rotatable supply member 49 is permitted and the supply-side movable portion 52 is rotated integrally with the rotatable supply member 49 during rotation thereof. By mounting the supply-side movable portion 52 in this way, the supply-side movable portion 52 is held in a state in which the claw portion 52*e* is contacted to the claw receiving portion 49*d* of the rotatable supply member 49 by an urging force of the urging member 54, and at the same time is movable in a direction F2 against an urging direction F1. Further, the supply-side movable portion 52 is provided with four projected portions 52*a*, 52*b*, 52*c* and 52*d*, and of these projected portions, the two projected portions 52*a* and 52*c* are provided with tapered portions (inclined surface portions) 52*a*1 and 52*c*1, respectively, as a force receiving portion.

The supply-side movable portion 52 is assembled at the following phase. That is, when the developer supply opening 43 is in the developer supply permitting state, as shown in (*a*) of FIG. 1, the supply-side movable portion 52 is assembled so that the projected portion 52*a* having the tapered portion 52*a*1 is disposed in a lower side. Therefore, when the supply-side movable portion 52 is in the developer supply stop state, the supply-side movable portion 52 is positioned in a position rotated by 90 degrees from the phase of the developer supply permitting position, and therefore the projected portion 52*d* is disposed in the lower side as shown in FIG. 14.

As shown in FIG. 12, a supply seal member 53 is provided between the receiving-side developer accommodating portion 40 and the supply shutter frame 48. The supply seal member 53 performs the function of preventing toner leakage from the connecting surface between the developer accommodating portion 40 and the supply shutter frame 48. Incidentally, the supply seal member 53 is provided with a through hole 53*a* correspondingly to the developer supply opening 43.

A connecting method between the developer accommodating portion 40 and the developer supply-side shutter 44 is the same as that between the receiving-side developer accommodating portion 15 and the developer receiving-side shutter 24 shown in FIG. 9, and therefore will be omitted from description.

[Opening and Closing Operation of Developer Receiving-side Shutter 24]

With reference to FIGS. 15 to 17, an opening and closing operation of the developer receiving-side shutter 24 when the developer supply cartridge T is mounted in the apparatus main assembly 100 in the state in which the process cartridge P is mounted in the apparatus main assembly 100. In FIG. 15, (*a*) to (*d*) are illustrations showing a first operation when the opening and closing operation of the developer receiving-side shutter 24 is performed. In FIG. 16, (*a*) and (*b*) are illustrations showing a second operation when the opening and closing operation of the developer receiving-side shutter 24 is performed. In FIG. 17, (*a*) and (*b*) are illustrations showing a third operation when the opening and closing operation of the developer receiving-side shutter 24 is performed.

Incidentally, in the state in which the process cartridge P is mounted in the apparatus main assembly 100, when the developer supply cartridge T is mounted in the apparatus main assembly 100, at first, the opening and closing operation of the developer receiving-side shutter 24 of the process cartridge P is performed. Thereafter, an opening and closing operation of the developer supply-side shutter 44 of the developer supply cartridge T is performed. However, in order to facilitate explanation of the operation, only the opening and closing operation of the developer receiving-side shutter 24 will be described, and details of the opening and closing operation of the developer supply-side shutter 44 will be described later.

Further, in FIGS. 15 to 17, for easy understanding of the operation, the receiving-side developer accommodating portion 15 of the process cartridge P and the developer accommodating portion 40 of the developer supply cartridge T are omitted from illustration. Further, the through hole 26*b* of the receiving rotatable member 26 of the developer receiving-side shutter 24 and the engaging portion 58*a* of the engaging member 58 of the developer supply cartridge T are shown by broken lines.

In the developer supply cartridge T, the rotatable supply member 49 is positioned in the developer supply stop position and the developer supply opening 43 is in the closed state in the state in which the developer supply cartridge T is not mounted in the apparatus main assembly 100. Further, in the process cartridge P, in the case where the process cartridge P is mounted in the apparatus main assembly 100 in the state in which the developer supply cartridge T is not mounted in the apparatus main assembly 100, the receiving-side movable portion 29 does not receive a force from any portion, and therefore the rotatable supply member 49 is positioned in the developer receiving step position. Therefore, the developer receiving opening 23 of the process cartridge P is in the closed state. At this time, a limiting recessed portion 31*a* of the limiting member 31 and the projected portion 29*a*1 of the receiving-side movable portion 29 are engaged with each other, and therefore rotation of the receiving-side movable portion is limited.

The opening and closing operation of the developer receiving-side shutter 24 is divided into the three (first to third) operations. The first operation is an operation for lowering the limiting member 31 of the process cartridge P by the engaging member 58 of the developer supply cartridge T. The second operation is an operation for rotating the receiving-side movable portion 29 by engagement of the engaging member 58 with the receiving-side movable portion 29. The third operation is an operation for raising the limiting member 31 by passing of the engaging member 58 through the limiting member 31. These three operations are continuously performed, so that the developer receiving-side shutter 24 is opened and closed.

[First Operation (Lowering of Limiting Member 31)]

The first operation will be described with reference to FIG. 15. In the state in which the process cartridge P is mounted in the apparatus main assembly 100, the developer supply cartridge T is gradually moved in the longitudinal direction (arrow H direction of (*a*) of FIG. 15) so as to be positioned in a predetermined mounting position in the apparatus main assembly 100. When the developer supply cartridge T is caused to enter the position of (*b*) of FIG. 15, the engaging portion 58*a* of the engaging member 58 contacts a first inclined surface portion 31*c* of a guide surface 31*b* of the limiting member 31. With further movement (entrance) of the developer supply cartridge T, as shown in (*c*) of FIG. 15, the limiting member 31 is guided by the engaging member 58 along the first inclined surface 31*c* (i.e., the limiting member 31 is urged downward (in the arrow U1 direction) by the engaging member 58). For this reason, the member 31 urged upward (in the arrow U2 direction) by the elastic force of the compression spring 34 is gradually moved downward (in the arrow U1 direction), where the receiving-side developer accommodating portion 15 is provided, against the elastic force. When the engaging portion 58*a* reaches a flat portion 31*d* of the guide surface 31*b*, the engagement between the limiting recessed portion 31*a* of the limiting member 31 and the projected portion 29*a*1 of the receiving-side movable portion 29 is eliminated (released). As a result, the receiving-side movable portion 29 is in a rotation-permitted state ((*d*) of FIG. 15).

[Second Operation (Rotation of Receiving-side Movable Portion 29]

The second operation will be described with reference to FIG. 16. After the receiving side movable portion 29 is placed in the rotation permitted state by the first operation described above, the engaging portion 58*a* is rotated while contacting the flat surface portion 31*d* of the limiting member 31 (while sliding on the flat surface portion 31*d* while urging the limiting member 31 downward at the flat surface portion 31*d*). Then, as shown in (*a*) of FIG. 16, the engaging portion 58*a* engages with the projected portion 29*a*3 of the receiving side movable portion 29 to further move the developer supply cartridge T while rotating the receiving side movable portion 29 in the counterclockwise direction. With the rotation of the receiving side recording material 29, the receiving rotatable member 26 of the developer receiving side shutter 24 is rotated in the counterclockwise direction. When the developer supply cartridge T is further moved to a position where the engagement between the engaging portion 58*a* and the projected portion 29*a* is eliminated (released), the receiving rotatable member 29 is rotated by 90 degrees. As a result, the receiving rotatable member 29 is positioned in the developer receiving permitting position to stop rotation thereof, thus being placed in the state in which the developer receiving opening 23 is open ((*b*) of FIG. 16).

[Third Operation (Raising of Limiting Member 31)]

The third operation will be described with reference to FIG. 17. After the developer receiving opening 23 is placed in the open state by the second operation described above, when the developer supply cartridge T is further moved to the inside of the apparatus main assembly 100, the limiting member 31 is placed in a state in which the limiting member 31 is guided by the engaging portion 58*a* at a second inclined surface portion 31*e*. That is, the limiting member 31 is moved upward while sliding with the engaging portion 58*a* at the second inclined surface portion 31*e* by an urging force of the compression spring 34. As a result, the limiting member 31 is moved upward (in the arrow U2 direction of (*a*) of FIG. 17) to a limiting position relative to the receiving-side developer accommodating portion 15. Then, when the engaging portion 58*a* passes through the guide portion 3 lb (i.e., is separated from the second inclined surface portion 31*e*), the projected portion 29*a*2 engages with the limiting recessed portion 31*e* of the limiting member 31, so that the limiting member 31 returns to the limiting position. As a result, the receiving-side movable portion 29 returns to the rotation-limited state ((*b*) of FIG. 17).

[Opening and Closing Operation of Developer Supply-side Shutter 44]

With reference to FIGS. 18 to 23, the opening and closing operation of the developer supply-side shutter 44 will be described. In FIG. 18, (*a*) and (*b*) are illustrations showing a state before engagement between the developer supply-side shutter and the receiving-side movable portion in the case where the developer supply opening is in the developer supply stop state. In FIG. 19, (*a*) and (*b*) are illustrations showing a state of the engagement between the developer supply-side shutter and the receiving-side movable portion. In FIG. 20, (*a*) and (*b*) are illustrations showing a state in which the engagement between the developer supply-side shutter and the receiving-side movable portion is eliminated and thus the mounting of the developer supply cartridge is completed. Incidentally, (*a*) of FIG. 18, (*a*) of FIG. 19 and (*a*) of FIG. 20 are schematic views each showing a state in which the developer supply-side shutter is seen in the rotational axis direction (front surface direction) of the developer supply-side movable portion. Further, (*b*) of FIG. 18, (*b*) of FIG. 19 and (*b*) of FIG. 20 are R-R sectional views of (*a*) of FIG. 18, (*a*) of FIG. 19 and (*a*) of FIG. 20, respectively. FIGS. 21 to 23 are illustrations showing an operation during the mounting of the developer supply-side shutter in the case where the developer supply-side opening is in the developer supply permitting state. Incidentally, (*a*) of FIG. 21, (*a*) of FIG. 22 and (*a*) of FIG. 23 are schematic views each showing a state in which the developer supply-side shutter is seen in the rotational axis direction (front surface direction) of the developer supply-side movable portion. Further, (*b*) of FIG. 21, (*b*) of FIG. 22 and (*b*) of FIG. 23 are R-R sectional views of (*a*) of FIG. 21, (*a*) of FIG. 22 and (*a*) of FIG. 23, respectively.

[Case where Developer Supply Opening 43 is Closed]

With reference to FIGS. 18 to 20, the case where the developer supply cartridge T is mounted in the apparatus main assembly 100 in a state in which the process cartridge P is mounted in the apparatus main assembly 100 and in which the developer supply opening 43 is closed will be described. In general, in a state in which the developer supply cartridge T is not mounted in the apparatus main assembly 100, the rotatable supply member 49 is positioned in the developer supply stop position and the developer supply opening 43 is in the closed state. Incidentally, similarly as the description of the opening and closing operation of the developer receiving-side shutter 24, for easy explanation of the operation, only the opening and closing operation of the developer supply-side shutter 44 will be described. Further, the through hole 49*b* of the rotatable supply member 49 of the developer supply-side shutter 44 is shown by a broken line.

As described above, the opening and closing operation of the developer supply-side shutter 44 is performed after the opening and closing operation of the developer receiving-side shutter 24. That is, when the opening and closing operation of the developer supply-side shutter 44 is performed, the opening and closing operation of the developer receiving-side shutter 24 has already been completed. In other words, rotation of the receiving-side movable portion 29 of the process cartridge P is limited by the limiting member 31, the receiving rotatable member 26 is positioned in the developer receiving permitting position, and the developer receiving opening 23 is in the open state.

As shown in FIG. 18, in the state in which the contact P is mounted in the apparatus main assembly 100, the developer supply cartridge T is moved into the apparatus main assembly 100 in the longitudinal direction (arrow H direction) so as to be positioned in a predetermined mounting position. The developer supply opening 43 is closed, and the rotatable supply member 49 is positioned in the developer supply stop position, and therefore the projected portion 52*d* of the supply-side movable portion 52 contacts the projected portion 29*a*4 of the receiving-side movable portion 29. At this time, the projected portions 52*d* and 29*a*4 contact each other at flat surface portions 52*d*1 and 29*a*41, respectively. Each of the flat surface portions 52*d*1 and 29*a*41 is a surface extending in a direction parallel to the urging direction F1 of the urging member 54 and is perpendicular to a movement direction of the developer supply cartridge T. Rotation of the receiving-side movable portion 29 is limited by the limiting member 31, and therefore the supply-side movable portion 52 receives a reaction force, against a force for pushing and moving the developer supply cartridge T, from the flat surface portion 29*a*41 at the flat surface portion 52*d*1 thereof, and thus is rotated in the counterclockwise direction (FIG. 19). With the rotation of the supply-side movable portion 52, also the rotatable supply member 49 of the developer supply-side shutter 44 is rotated in the counterclockwise direction. When the developer supply cartridge T is further moved to a position where the engagement between the receiving-side movable portion 29 and the projected portion 52*d* is eliminated, the rotatable supply member 49 is placed in a state in which the rotatable supply member 49 is rotated by 90 degrees from the state before the contact with the receiving-side movable portion 29. As a result, the rotation of the rotatable supply member 49 is stopped, so that the developer supply opening 43 is placed in an open state (FIG. 20). This position is a mounting completion position of the developer supply cartridge T.

[Case where Developer Supply Opening 43 is Open]

With reference to FIGS. 21 to 23, the case where the developer supply cartridge T is mounted in the apparatus main assembly 100 in a state in which the process cartridge P is mounted in the apparatus main assembly 100 and in which the developer supply opening 43 is open will be described. As described above, in general, the rotatable supply member 49 is positioned in the developer supply stop position and the developer supply opening 43 is in the closed state. However, there is a possibility that the supply-side movable portion 52 is rotated by, e.g., accidental touch of the supply-side movable portion 52 by a user to move the rotatable supply member 49 from the developer supply stop position to the developer supply permitting position, thereby to place the developer supply opening in the open state. Incidentally, also in this case, only the opening and closing operation of the developer supply-side shutter 44 will be described. Also the state of the developer receiving-side shutter 24 is the same as that in the case where the developer supply opening 43 is positioned in the developer supply stop position. Further, the through hole 49*b* of the rotatable supply member 49 of the developer supply-side shutter 44 is shown by a broken line.

In the state in which the process cartridge P is mounted in the apparatus main assembly 100, the developer supply cartridge T is gradually inserted into the apparatus main assembly 100 (in the arrow H direction in (*a*) of FIG. 21). At this time, the developer supply opening 43 is in the open state, and the rotatable supply member 49 is positioned in the developer supply permitting position. In this state, when the developer supply cartridge T is inserted into the apparatus main assembly 100, the tapered portion 52*a*1 of the projected portion 52*a* of the supply-side movable portion 52 contacts a tapered portion (inclined surface portion) 29*a*42 of the projected portion 29*a*4 of the receiving-side movable portion 29 of the process cartridge P. Then, when the developer supply cartridge T is further inserted, the supply-side movable portion 52 receives a load exerted in the F2 direction, against the urging direction Fl of the urging member 54, by the contact between the tapered portions 52*a*1 and 29*a*42, so that the supply-side movable portion 52 is moved in HF direction relative to the receiving-side movable portion 29 (FIG. 22). That is, a component of the reaction force against the force for pushing and moving the developer supply cartridge T acts in the F2 direction from the tapered portion 29*a*42 of the receiving-side movable portion 29 to the tapered portion 52*a*1 of the supply-side movable portion 52. By receiving this force, the supply-side movable portion 52 is moved in the F2 direction while the tapered portion 52*a*1 thereof slides with the tapered portion 29*a*42 of the receiving-side movable portion 29 (preventing operation). Then, the supply-side movable portion 52 is placed, when the contact between the tapered portions 52*a*1 and 29*a*42 is ended, in a state in which the supply-side movable portion 52 rides on the receiving-side movable portion 29 (FIG. 23), and in this preventing position, the supply-side movable portion 52 is moved (slid) in the mounting direction H relative to the receiving-side movable portion 29. Thereafter, when the projected portion 52*a* is aligned with a groove portion 29*e* with respect to a direction perpendicular to the mounting direction H, the suppy-side movable portion 52 is moved in the F1 direction so that the projected portion 52*a* is engaged into the groove portion 29*e* by the urging force of the urging member 54 (FIG. 20). As a result, the supply-side movable portion 52 is engageable with the receiving-side movable portion 29 without performing the rotational operation, and therefore the developer supply opening 43 if kept in the open state as it is.

Incidentally, it would be also considered that a position where the supply-side movable portion 52 starts the movement thereof by the engagement with the receiving-side movable portion 29 is an intermediary position between the supply stop position (first position) and the supply permitting position (second position). Also in this case, at the time of completion of the mounting of the developer supply cartridge T, it is possible to place the developer supply opening 43 in the open state. An operation in this case is performed, depending on the position (phase) of the supply-side movable portion 52, in either of the following two patterns. One is the pattern in which the supply-side movable portion 52 is once moved to the supply stop position by the engagement with the receiving-side movable portion 29, and then similarly as in the above described case where the developer supply cartridge T is mounted in the closed state of the developer supply opening 43, the supply-side movable portion 52 is moved to the supply permitting position by the engagement with the receiving-side movable portion 29. The other one is the pattern in which the supply-side movable portion 52 is moved to the supply permitting position by the engagement with the receiving-side movable portion 29, and then similarly as in the above described case where the developer supply cartridge T is mounted in the open state of the developer supply opening 43, the supply-side movable portion 52 is kept in the supply permitting position as it is.

The supply-side movable portion 52 varies, depending on the above-described intermediary position, in state of the contact between the projected portion 52*a* thereof and the projected portion 29*a* of the receiving-side movable portion 29 and in force applied from the projected portion 29*a* to the projected portion 52*a*, and therefore a rotational direction thereof varies depending on a degree of pushing-in of the developer supply cartridge T after the contact. For example, in the case of the intermediary position such that a side portion of the projected portion 52*a* in a downstream side with respect to the counterclockwise rotational direction of the projected portion 52*a* slightly contacts an end of the projected portion 29*a*, the supply-side movable portion 52 exhibits a behavior such that the supply-side movable portion 52 is once rotated in (returned into) the opposite direction. That is, the supply-side movable portion 52 is rotated in the clockwise rotational direction by the pushing-in of the developer supply cartridge T. Therefore, a projected portion downstream of the first contacting projected portion 52*a* with respect to the counterclockwise rotational direction is engaged with the projected portion 29*a*. The supply-side movable portion 52 is not rotated when this projected portion is provided with the tapered portion (52*a*1) but is rotated when this projected portion is not provided with the tapered portion (52*a*1).

Further, in the case where the intermediary position is such a position that an upstream-side portion of the tapered portion 52*a*1 with respect to the counterclockwise rotational direction first contacts the projected portion 29*a*, the supply-side movable portion 52 rotates until the tapered portion 52*a*1 exhibits a phase where the transfer 52*a*1 surface-contacts the tapered portion of the projected portion 29*a* (i.e., the closed position). An operation subsequent to the rotation is the same as the operation in the above-described case where the developer supply cartridge T is mounted in the open state of the developer supply opening 43.

Further, in the case where the projected portion 52*a* provided with no tapered portion 52*a*1 first contacts the projected portion 29*a*, the supply-side movable portion 52 rotates in the counterclockwise direction except for the case where the supply-side movable portion 52 is once returned in the clockwise rotational direction as described above. An operation subsequent to the rotation is the same as the operation in the above-described case where the developer supply cartridge T is mounted in the closed state of the developer supply opening 43.

Incidentally, in this embodiment, the opening and closing operation of the developer supply opening in the case where the developer supply cartridge T is mounted in a state in which the process cartridge P has already been mounted into the apparatus main assembly 100 was described, but the process cartridge P may also be mounted after the mounting of the developer supply cartridge T. Also in this case, an operation similar to the above-described operation is performed. That is, in the case where the developer supply opening 43 of the developer supply cartridge T is in the closed state in the apparatus main assembly 100, the supply-side movable portion 52 is engaged with the receiving-side movable portion 29 to be positioned at the supply permitting position. Further, in the case where the developer supply opening 43 is in the open state, the supply-side movable portion 52 is engaged with the receiving-side movable portion 29 at their tapered portions, and is moved in the urging direction of the urging member 54. Then, after the groove portion 29*c* of the receiving-side movable portion 29 passes through the projected portion 52*a* of the supply-side movable portion 52, the supply-side movable portion 52 is engaged with the groove portion 29*c* of the receiving-side movable portion 29 by the urging force of the urging member 54. As a result, the developer supply opening 43 is placed in the open state.

As described above, according to this embodiment, even when the developer supply opening is in any opening and closing state during the mounting of the developer supply cartridge in the apparatus main assembly of the image forming apparatus, it is possible to place the developer supply opening in the open state at the time of completion of the mounting of the developer supply cartridge.

(Other Embodiments)

In Embodiment, the color electrophotographic image forming apparatus using the four developer supply cartridges and the four process cartridges was described as an example, but the present invention is not limited thereto. It is possible to apply the present invention to a developer supply cartridge and a process cartridge for use with a monochromatic (single color) electrophotographic image forming apparatus.

In this embodiment, as a constitution for performing the preventing operation of the movable portion, a constitution in which the movable portion is provided with the inclined surface as the force receiving portion and is moved to the preventing position by sliding thereof with the inclined surface is employed, but the present invention is not limited to this constitution. That is, the constitution in which the slidable surfaces slide with each other in a surface contact manner as in this embodiment may also be not required to be employed, but for example, a constitution in which the slidable surfaces slide with each other in a manner such that a plane (surface) as one slidable surface and a corner or spherical portion as the other slidable surface point-contact each other may also be employed.

In this embodiment, the constitution in which the movable portion of the developer supply cartridge performs the preventing operation from the engaging portion of the process cartridge is employed, but a reverse constitution, i.e., a constitution in which the engaging portion performs the preventing operation from the movable portion may also be employed.

Further, in Embodiment, as the constitution for permitting the communication between the opening and the outside when the developer supply opening and the developer receiving opening are open, the constitution in which the rotatable member is provided with the through hole is used, but the present invention is not limited to the constitution. For example, it is also possible to employ a constitution in which a cut-away recessed portion is provided in place of the through hole.

Further, in Embodiment, the constitution in which the process cartridge is provided with the first engaging portion as the means for moving the movable portion is employed, but the engaging portion may only be required to be fixed to the movable developer supply cartridge in the apparatus main assembly side, and therefore a constitution in which the engaging portion is provided in the apparatus main assembly may also be employed.

Further, the constitution in which such an engaging portion is provided as a part of the structure of the shutter mechanism for opening and closing the developer receiving opening of the process cartridge, i.e., a constitution in which the movable portion in the receiving-side shutter mechanism also functions as the engaging portion is employed, but it is also possible to employ a constitution in which the engaging portion may also be provided as a separate member. However, from viewpoints of reduction in the number of parts and space saving, the first engaging portion may preferably be integrated with the structure of the shutter mechanism of the process cartridge.

Further, in Embodiment, the constitution in which the shutter portion and the movable portion in the present invention are provided in the developer supply cartridge and in which the engaging portion in the present invention is provided to the apparatus main assembly and the process cartridge was employed. However, it is also possible to employ a constitution in which the opening and closing structures of these portions are provided reverse to each other. That is, a constitution in which the shutter portion and the movable portion in the present invention are provided in the apparatus main assembly or the process cartridge and in which the engaging portion in the present invention is provided to the developer supply cartridge may be employed.

Further, it is also possible to employ a constitution in which the engaging portion in the present invention is not provided to the apparatus main assembly but are provided to the process cartridge and in which the developer supply cartridge is capable of being mounted to the process cartridge before the process cartridge is mounted in the apparatus main assembly. In this case, the developer supply cartridge and the process cartridge are integrated with each other, and then are mounted in the apparatus main assembly.

Further, in Embodiment, as the opening and closing constitution of the shutter portion, the constitution in which the shutter portion is repeatedly moved between the rotation phase in the closed position and the rotation phase in the open position by the rotation of the rotatable member was used, but the present invention is not limited thereto. For example, it is also possible to employ a constitution in which the shutter portion is constituted so that a force exceeding an urging force of the urging means such as the spring is applied thereto and so that the shutter portion is repeatedly moved (reciprocated) between the closed position and the open position by controlling the force.

According to the present invention, even in the case where the developer supply opening is in any opening and closing state when the developer supply cartridge is mounted to the image forming apparatus main assembly or the process cartridge, the developer supply opening can be placed in the open state during completion of the mounting of the developer supply cartridge.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications No. 069426/2013 filed Mar. 28, 2013, which is hereby incorporated by reference.

What is claimed is:

1. A developer supply cartridge detachably mountable to a main assembly of an image forming apparatus for forming an image on a recording material by developer, said developer supply cartridge comprising:

an accommodating portion, provided with a supply opening for permitting discharge of developer, for accommodating the developer;

a shutter portion movable between a closed position where the supply opening is closed from an outside of said accommodating portion and an open position where the supply opening is open to the outside; and a movable portion for moving said shutter portion, wherein said movable portion is movable between a first position where said shutter portion is positioned in the closed position and a second position where said shutter portion is positioned in the open position, and wherein said movable portion in the first position is engaged with an engaging portion so that said movable portion is moved with the movement of said developer supply cartridge and then said movable portion is positioned in the second position when said developer supply cartridge reaches a mounting position, the mounting position being a position where said developer supply cartridge is mounted to the main assembly, wherein said movable portion performs a preventing operation for preventing movement thereof to the first position when said movable portion is positioned in the second position during mounting of said developer supply cartridge to the main assembly, and wherein, said movable portion is moved from the second position to a preventing position in the preventing operation, the preventing position being a position where said shutter portion is positioned in the open position and said movable portion is located at a position different from the second position.

2. A developer supply cartridge according to claim 1, wherein when said movable portion moves to the preventing position and then, when said developer supply cartridge reaches the mounting position, said movable portion returns from the preventing position to the second position.

3. A developer supply cartridge according to claim 1, wherein said movable portion includes a force receiving portion for receiving a force from the engaging portion in contact with the engaging portion during the mounting of said developer supply cartridge to the main assembly, and wherein said movable portion is moved from the second position to the preventing position by the force applied from the engaging portion to said force receiving portion when said movable portion is positioned in the second position during the mounting of said developer supply cartridge to the main assembly.

4. A developer supply cartridge according to claim 3, further comprising urging means for urging said movable portion so as to move from the preventing position to the second position, wherein said movable portion is moved from the second position to the preventing position, in a state in which an urging force of said urging means is applied to said movable portion, by the force applied from the engaging portion to said force receiving portion, and is returned from the preventing position to the second position when said developer supply cartridge reaches the mounting position.

5. A developer supply cartridge according to claim 3, wherein said force receiving portion in an inclined surface inclined with respect to a movement direction of said developer supply cartridge, and said force receiving portion receives a force from the engaging portion for moving said movable portion from the second position to the preventing position by movement of said developer supply cartridge.

6. A developer supply cartridge according to claim 1, wherein said movable portion is moved to the second position by engagement with the engaging portion when said movable portion is positioned between the first position and the second position during the mounting of said developer supply cartridge to the main assembly.

7. A developer supply cartridge according to claim 1, wherein said shutter portion is a rotatable member and has a shape such that said rotatable member is capable of blocking the supply opening from the outside in a rotational phase in the closed position and is capable of opening the supply opening to the outside in a rotational phase in the open position.

8. A developer supply cartridge according to claim 7, wherein said shutter portion is provided with a through hole formed so as to permit communication between the supply opening and the outside in the rotational phase in the open position.

9. A developer supply cartridge according to claim 1, further comprising driving means for driving a shutter mechanism for opening and closing a receiving opening of a developer accommodating portion of a process cartridge mounted to the main assembly.

10. A developer supply cartridge according to claim 9, wherein said driving means drives the shutter mechanism so that the receiving opening is placed in an open state before movement of said shutter portion is started.

11. A developer supply cartridge according to claim 1, wherein said movable portion is moved by engagement with the engaging portion provided to a process cartridge mounted to the main assembly.

12. A developer supply cartridge according to claim 1, wherein said movable portion is provided by engagement with the engaging portion provided to the main assembly.

13. A developer supply cartridge detachably mountable to a process cartridge, detachably mountable to a main assembly of an image forming apparatus, for performing an image forming process for forming an image on a recording material by developer, said developer supply cartridge comprising:

an accommodating portion, provided with a supply opening for permitting discharge of developer, for accommodating the developer;

a shutter portion movable between a closed position where the supply opening is blocked from an outside of said accommodating portion and an open position where the supply opening is open to the outside; and a movable portion for moving said shutter portion, wherein said movable portion is movable between a first position where said shutter portion is positioned in the closed position and a second position where said shutter portion is positioned in the open position, and wherein during movement of said developer supply cartridge to a mounting position when said developer supply cartridge is mounted to the process cartridge, said movable portion is moved with the movement of said developer supply cartridge by engagement thereof with an engaging portion provided to the process cartridge so that said movable portion is engaged with the engaging portion in the first position to start movement thereof and is positioned in the second position when said developer supply cartridge reaches the mounting position, wherein said movable portion performs a preventing operation for preventing movement thereof to the first position by engagement thereof with the engaging portion when said movable portion is positioned in the second position during mounting of said developer supply cartridge to the process cartridge, and wherein, when said movable portion is positioned in the second position during the mounting of said developer supply cartridge to the main assembly, until said developer supply cartridge reaches the mounting position said movable portion prevents the movement thereof to the first position by movement thereof from the second position to a preventing position by the engagement thereof with the engaging portion.

14. A process cartridge, detachably mountable to a main assembly of an image forming apparatus, for performing an image forming process for forming an image on a recording material by a developer, said process cartridge comprising:

a developer supply cartridge according to claim 13 detachably mounted thereto.

15. An image forming apparatus for forming an image on a recording material by a developer, comprising:

a developer supply cartridge according to claim 1.

16. An image forming apparatus according to claim 15, further comprising a process cartridge, detachably mountable to the main assembly, for performing an image forming process for forming an image on a recording material by the developer.

17. A developer supply cartridge detachably mountable to a main assembly of an image forming apparatus, said developer supply cartridge comprising:

an accommodating portion, provided with a supply opening for permitting discharge of developer, for accommodating the developer;

a shutter portion movable between a closed position where the supply opening is blocked from an outside of said accommodating portion and an open position where the supply opening is open to the outside; and a movable portion, having first and second projected portions, for moving said shutter portion, wherein when said developer supply cartridge is mounted to the main assembly and said first projected portion engages with an engaging portion provided in a main assembly side, said first projected portion is moved so that said shutter portion is moved from said closed position to said open position, and wherein, if said second projected portion engages with the engaging portion, said second projected portion slides while contacting the engaging portion so that said movable portion performs a preventing operation for preventing movement thereof.

18. A developer supply cartridge according to claim 1, wherein said movable portion includes first and second projected portions.

19. A developer supply cartridge according to claim 13, wherein said movable portion includes first and second projected portions.

20. A developer supply cartridge according to claim 18, wherein said movable portion includes first and second projected portions.

21. A developer supply cartridge according to claim 19, wherein said second projected portion includes a tapered portion.

22. A developer supply cartridge according to claim 17, wherein said second projected portion includes a tapered portion.

23. A developer supply cartridge according to claim 18, wherein said second projected portion includes a tapered portion.

24. A developer supply cartridge according to claim 19, wherein said second projected portion slides while contacting the engaging portion.

* * * * *